US006411268B1

(12) United States Patent
Nakamura et al.

(10) Patent No.: US 6,411,268 B1
(45) Date of Patent: Jun. 25, 2002

(54) PLASMA DISPLAY UNIT WITH NUMBER OF SIMULTANEOUSLY ENERGIZABLE PIXELS REDUCED TO HALF

(75) Inventors: Tadashi Nakamura; Masayuki Kimura; Mitsuhiro Ishizuka; Shinji Hirakawa; Yukinori Kashio, all of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/471,996

(22) Filed: Dec. 23, 1999

(30) Foreign Application Priority Data

Dec. 25, 1998 (JP) ..... 10-371326

(51) Int. Cl.[7] ..... G09G 3/10; G09G 3/28; G09G 3/36; H01J 17/00; H01J 17/49

(52) U.S. Cl. ..... 345/60; 345/67; 345/68; 345/96; 345/209; 313/581; 313/584; 315/169.1; 315/169.4

(58) Field of Search ..... 345/60, 65, 67, 345/68, 95, 96, 204, 208, 209; 315/169.1–169.4; 313/582, 584, 501

(56) References Cited

U.S. PATENT DOCUMENTS

| | | | | |
|---|---|---|---|---|
| 5,231,382 A | * | 7/1993 | Tanaka | 315/169.4 |
| 5,363,225 A | * | 11/1994 | Minamihara et al. | 345/95 |
| 5,748,165 A | * | 5/1998 | Kubota et al. | 345/96 |
| 5,790,087 A | * | 8/1998 | Shigeta et al. | 345/67 |
| 5,818,408 A | * | 10/1998 | Mihara et al. | 345/96 |
| 6,249,087 B1 | * | 6/2001 | Takayama et al. | 315/169.4 |

FOREIGN PATENT DOCUMENTS

| | | |
|---|---|---|
| JP | 6-250601 | 9/1994 |
| JP | 6-274126 | 9/1994 |
| JP | 8-211858 | 8/1996 |
| JP | 9-68945 | 3/1997 |
| JP | 11-38931 | 2/1999 |
| JP | 11-119729 | 4/1999 |
| JP | 3112820 | 11/2000 |
| KR | 97-17861 | 9/1995 |

* cited by examiner

*Primary Examiner*—Bipin Shalwala
*Assistant Examiner*—David L Lewis
(74) *Attorney, Agent, or Firm*—Hutchins, Wheeler & Dittmar

(57) ABSTRACT

A plasma display unit applies data pulses of a predetermined polarity to data electrodes in odd-numbered columns and applies data pulses of an opposite polarity to data electrodes in even-numbered columns. The plasma display unit applies scanning pulses which are inverted between positive and negative polarities in first and second states that occur alternately, to scanning electrodes in odd-numbered rows, and applies scanning pulses which are inverted between positive and negative polarities in the first and second states in opposite relation to the scanning pulses applied to the scanning electrodes in odd-numbered rows, to scanning electrodes in even-numbered rows. Pixels arranged vertically and horizontally in a two-dimensional matrix are alternately energized in a staggered grid pattern, so that the number of pixels that are simultaneously energized is half the number of pixels of a conventional plasma display unit. A writing failure of wall charges due to a voltage drop of scanning pulses is prevented from occurring with an AC-discharge, surface-discharge plasma display unit having an increased size.

34 Claims, 21 Drawing Sheets

Fig.5a (Prior Art)
Fig.5b (Prior Art)
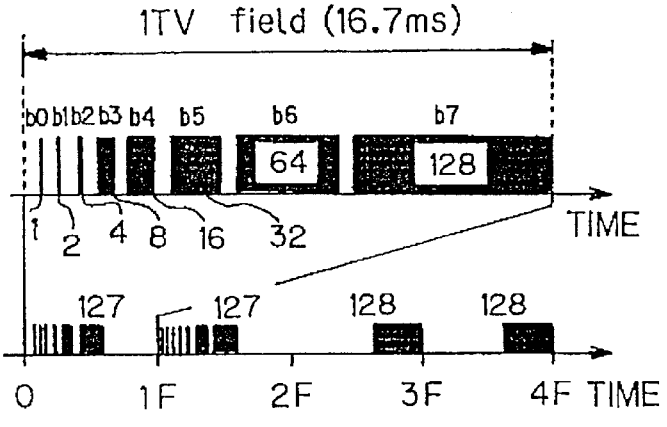
Fig.6(Prior Art)
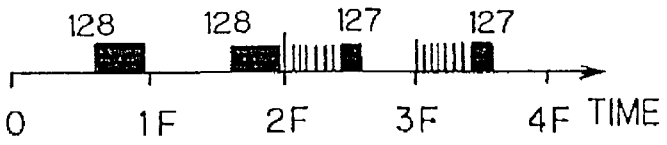

PLASMA DISPLAY UNIT WITH NUMBER OF SIMULTANEOUSLY ENERGIZABLE PIXELS REDUCED TO HALF

BACKGROUND OF THE INVENTION

1. Field of the Invention

The present invention relates to a plasma display unit, and more particularly to an AC-discharge, memory-type plasma display unit.

2. Description of the Related Art

Plasma display units emit visible light to energize pixels by producing an electric discharge in a rare gas such as of Ne or Xe to generate ultraviolet radiation for exciting phosphors to emit visible light. The plasma display units display images in the form of a dot matrix, and are drawing attention as flat display units capable of emitting-light with high luminance.

CRTs (Cathode-Ray Tubes), which are a typical image display unit, have an appreciable depth that increases as the screen size increases. However, the depth of a plasma display unit does not increase even if its screen size increases.

LCD (Liquid Crystal Display) units have individual display cells, and their yield sharply drops when their screen size increases. However, the yield of plasma display units is not greatly reduced when their screen size increases because display cells are provided by points of intersection of vertical and horizontal electrodes.

Plasma display units include DC-discharge and AC-discharge types. The AC-discharge plasma display units have a dielectric protective film over the electrodes which are therefore not exposed to a discharge space. Consequently, the AC-discharge plasma display units have a much longer service life than the DC-discharge plasma display units whose electrodes are exposed.

The AC-discharge plasma display units are divided into refresh-type and memory-type plasma display units depending on how they are energized. The memory-type plasma display units produce wall charges using the dielectric on the electrodes, and generate an electric discharge by giving and receiving such wall charges.

More specifically, when a number of display cells in the display panel of a memory-type plasma display unit are successively scanned, wall charges are written in only those display cells which are to emit light according to image data. After the writing of the wall charges is completed, sustaining pulses are repeatedly applied to all the display cells, enabling only the display cells in which the wall charges are written to generate an electric discharge to emit light.

In such a memory-type plasma display unit, it is difficult to control the luminance of light by controlling the intensity of the electric discharge. Therefore, it is the general practice to control the number of times that a sustaining pulse is applied per display cell for thereby changing the visually perceived luminance to express gradations.

The AC-discharge plasma display units include surface-discharge AC-discharge plasma display units which have surface-discharge electrode pairs of scanning and sustaining electrodes placed in a plane, and facing-discharge AC-discharge plasma display units which produce an electric discharge between facing substrates. The surface-discharge AC-discharge plasma display units are expected as large-size, full-color flat display units because it is easier to develop electrostatic capacitance for forming wall charges, a memory margin is wider, phosphors are less degraded, and the emission efficiency is better.

One conventional AC-discharge, memory-type, surface-discharge plasma display unit will be described below with reference to FIGS. 1 through 3 of the accompanying drawings. For illustrative purposes, it is assumed that scanning and sustaining electrodes extend in a row direction, and data electrodes extend in a column direction.

As shown in FIG. 1, a plasma display unit 1 comprises a display panel 2 and a drive circuit 3. The display panel 2 has various electrodes connected to the drive circuit 3.

The display panel 2 includes a front transparent insulating substrate 15 and a rear insulating substrate 16. On the inner surface of the front transparent insulating substrate 15, there are disposed m surface-discharge electrodes pairs 10 comprising parallel scanning and sustaining electrodes 11, 12 as row electrodes parallel to the row direction and juxtaposed in the column direction.

On the inner surface of the rear insulating substrate 16, there are disposed n data electrodes 14 as column electrodes parallel to the column direction and juxtaposed in the row direction. A discharge space 13 filled with a rare gas including Xe is defined in the gap between the insulating substrates 15, 16.

Since the scanning and sustaining electrodes 11, 12 are positioned in front of light spots, they are usually made of an electrically conductive material that is highly light transmissive, such as ITO (Indium Tin Oxide). However, the material is not electrically conductive enough, so narrow trace electrodes 17, 18 of metal are placed on the scanning and sustaining electrodes 11, 12. A dielectric layer 19 and a protective layer 20 are successively placed on the trace electrodes 17, 18. The scanning and sustaining electrodes 11, 12 confront the discharge space 13 through the trace electrodes 17, 18, the dielectric layer 19, and the protective layer 20.

A dielectric layer 22 is disposed on the data electrodes 14 on the inner surface of the rear insulating substrate 16. Partitions 21 for blocking the propagation of electric discharges and spacing the insulating substrates 15, 16 from each other are disposed on the dielectric layer 22 and positioned between the data electrodes 14. A phosphor layer 23 is positioned on the surface of the dielectric,layer 22 and sides of adjacent two of the partitions 21.

The m surface-discharge electrodes pairs 10 and the n data electrodes 14 cross each other with the discharge space 13 interposed therebetween, providing m×n points of intersection successively arranged in the row and column directions as display cells 24 that serve as pixels for individually emitting light.

As shown in FIG. 1, the m scanning electrodes 11 have left ends connected respectively to m scanning wires 25, to which in scanning drivers 26 are individually connected. The m sustaining electrodes 12 have right ends connected in common to a single sustaining wire 27, to which a single sustaining driver 28 is connected.

To the n data electrodes 14, there are connected n data drivers 29, respectively. The above drives 26, 28, 29 jointly make up the drive circuit 3.

The AC-discharge, surface-discharge plasma display unit 1 is capable of displaying a desired image in the form of a dot matrix by individually controlling the m×n display cells 24 for light emission. A process of energizing the plasma display unit 1 will be described below with reference to FIG. 3.

In FIG. 3, "Wu" represent sustaining pulses applied from the single sustaining driver 28 in common to the m sustaining electrodes 12, "Ws1–Wsm" scanning pulses applied from the m scanning drivers 26 individually to the m scanning electrodes 11, and "Wd" data pulses applied from the n data drivers 29 individually to the n data electrodes 14 with respect to those display cells 24 in which wall charges are to be written.

In a priming period A, preliminary discharge pulses Pp1, Pp2 are applied respectively to all the sustaining electrodes 12 and all the scanning electrodes 11, generating active particles and wall charges in the discharge space 13. Then, preliminary discharge erasing pulses Ppe are applied to the scanning electrodes 11 to erase excessive wall charges, developing a condition for stably writing wall charges.

In a scanning period B, the m scanning drivers 26 applies base pulses Pbw uniformly and also scanning pulses Pw at successively shifted times to the m scanning electrodes 11. In synchronism with these times, the n data drivers 29 apply data pulses Pd to certain data electrodes 14 which correspond to an image to be displayed.

Those display cells 24 where a pulse voltage in excess of a discharge threshold is applied to the scanning and data electrodes 11, 14 produce an electric discharge, writing wall charges into the surfaces of the dielectric layers 19, 20 on the scanning electrodes 11. As the wall charges grow, the effective voltage in the display cells 24 is lowered, storing substantially constant charges that are limited by the potential difference between the scanning pulses Pw and the data pulses Pd and the electrostatic capacitance of the stored region.

The base pulses Pbw are applied to the scanning electrodes 11 in the scanning period B in order to prevent the wall charges from being eliminated by an opposite electric discharge caused by the developed wall charges.

In a sustaining period C, sustaining pulses Pu, Ps are applied alternatively to all of the sustaining electrodes 12 and all of the scanning electrodes 11. In those display cells 24 where the wall charges are written, since the voltage of the wall charges is added to the sustaining pulses Pu, Ps, an electric discharge in excess of the discharge threshold is produced in the display cells 24 even though the voltage amplitude of the sustaining pulses Pu, Ps is low, and is sustained by the continued application of the sustaining pulses Pu, Ps. The first sustaining pulses Pu, Ps in the sustaining period C are set up such that the wall charges developed on the scanning electrodes 11 by the electric discharge are transferred to the sustaining electrodes 12.

As shown in FIG. 3, the time at which sustaining pulses Ps applied to the scanning electrodes 11 and the time at which the sustaining pulses Pu applied to the sustaining electrodes 12 are not the same as each other. Consequently, a state in which currents flow from the scanning electrodes 11 to the sustaining electrodes 12 as shown in FIG. 1, and a state (not shown) in which currents flow from the sustaining electrodes 12 to the scanning electrodes 11 occur alternately to each other.

With these states occurring alternately to each other, the direction of the sustaining pulses supplied to the surface-discharge electrodes pairs 10 is reversed. An electric discharge is produced in only the positions of the display cells 24 where the wall charges have been written, causing the phosphor layers 23 of those display cells 24 to emit light for thereby displaying an image.

In an erasing period D, the m scanning drivers 26 apply wide sustain erasing pulses Pe whose voltage gradually increases to the m scanning electrodes 11 for thereby stopping the above sustaining electric discharge, ending the display of the image. At this time, the display of one frame of image on the plasma display unit is completed. The above cycle of operation may be repeated to display a succession of images for thereby displaying a moving image.

For displaying a color image-on the plasma display unit 1, as shown in FIG. 4 of the accompanying drawings, data electrodes 14 may be arranged at a three-fold density, and three vertically long display cells 24 for R (Red), G (Green), and B (Blue) light emission may be combined to form a single pixel.

In the plasma display unit 1, it is easy to select energization and de-energization of the display cells 24, but it is difficult to adjust the luminance thereof in an analog fashion. Therefore, if a multi-gradation image is to be displayed on the plasma display unit 1, then a subfield process for combining a plurality of subfields with different emission luminance values to achieve a desired gradation is employed.

Specifically, since the display cells 24 of the plasma display unit 1 emit light when sustaining pulses are applied thereto while wall charges are being written therein, the subfield process controls the number of sustaining pulses to be applied to adjust the emission luminance values of the display cells 24 as emission times based on the integrating effect of visual perception.

For example, if a 256-gradation video signal is to be displayed in 8-bit binary gradations, then as shown in FIG. 5*a* of the accompanying drawings, it is possible to control a displayed gradation of a desired display cell 24 by energizing the display cell 24 with 8 subfields having respective numbers of sustaining pulses at ratios of "1:2:4: . . . :128".

When the gradation level of a certain display cell 24 changes from 127 to 128, as shown in FIG. 5*b* of the accompanying drawings, a sustaining electric discharge is generated in a first frame by 7 subfields weighted by "1, 2, . . . , 64" such that the total weight is 127, and a sustaining electric discharge is generated in a second frame by only one subfield weighted by "128".

In the above AC-discharge, memory-type, surface-discharge plasma display unit 1, scanning pulses are successively applied to all of the scanning electrodes 11, and data pulses are applied to certain data electrodes 14 to write wall charges in the positions of certain display cells 24. Sustaining pulses are applied the scanning electrodes 11 and the sustaining electrodes 12 to cause the display cells 24 where the wall charges have been written to emit light for thereby displaying an image in the form of a dot matrix.

In the plasma display unit 1, however, since images are displayed by the action of electric discharges, the wall charges and the sustaining pulses are of a high voltage of several hundred volts. When the sustaining pulses are applied, because currents of the sustaining pulses are supplied parallel to all the display cells 24 where light is to be emitted, the electric power required to display images on the plasma display unit 1 is very high. If there are many display cells 24 that are needed to emit light, then the plasma display unit 1 may develop an undue voltage drop, tending to bring about a light emission failure.

Basically, each of the display cells 24 of the plasma display unit 1 is capable of expressing two alternate values. The subfield process, however, makes it possible to display images in multiple gradations. When a multi-gradation moving image is displayed on the plasma display unit 1 according to the subfield process, the plasma display unit 1 is liable to suffer a fault known as moving-image false contouring.

As described above with reference to FIG. 5(*b*), sustaining pulses are concentrated in the former part of a frame for displaying the gradation level of 127, and sustaining pulses are concentrated in the latter part of a frame for displaying the gradation level of 128.

Therefore, a sustaining emission blank period is present between the frames where the gradation level changes from 127 to 128. Due to the sustaining emission blank period, the viewer visually recognizes the image as being instantaneously darker than the gradation level to be displayed.

When the gradation level changes from 128 to 127, as shown in FIG. 6 of the accompanying drawings, inasmuch as sustaining pulses are concentrated between the frames, the viewer visually recognizes the image as being instantaneously brighter than the gradation level to be displayed.

Therefore, when a relatively wide image area whose lightness varies smoothly, such as a cheek of a person, moves in the display screen, moving-image false contouring characterized by dark contours and bright contours appears in the smooth image area. If the image is a color image, then the moving-image false contouring is visually recognized as a color shift, resulting in a highly degraded display quality.

SUMMARY OF THE INVENTION

It is therefore an object of the present invention to provide a plasma display unit which prevents a display failure due to a voltage drop even if the plasma display unit has an increased screen size, can reduce electric field noise and magnetic noise, and reduce the effect of moving-image false contouring when gradation images are displayed according to the subfield process.

According to a first aspect of the present invention, there is provided a plasma display unit having a plurality of surface-discharge electrode pairs of scanning electrodes and sustaining electrodes extending parallel to a row direction and juxtaposed in a column direction, a plurality of data electrodes extending parallel to the column direction and juxtaposed in the row direction and defining pixels at positions where the data electrodes cross said surface-discharge electrode pairs, and a discharge space positioned in a gap between said data electrodes and said surface-discharge electrode pairs and containing a phosphor therein, the arrangement being such that scanning pulses are successively applied to said scanning electrodes and data pulses depending on an image are successively applied to said data electrodes to write wall charges in pixels corresponding to the image, and sustaining pulses flowing in alternately inverted directions are applied to said surface-discharge electrode pairs to cause an electric discharge in the positions of the pixels in which the wall charges are written, for thereby enabling the phosphor in said discharge space to emit light for thereby displaying a dot-matrix image, said plasma display unit comprising first set column writing means for applying data pulses of a predetermined polarity to said data electrodes in first set columns for writing the wall charges, second set column writing means for applying data pulses whose positive and negative polarities are opposite to the data pulses applied by said first set column writing means, to said data electrodes in second set columns other than said first set columns for writing the wall charges, first set row writing means for applying scanning pulses which are inverted between positive and negative polarities in first and second states which occur alternately, to said scanning electrodes in first set rows for writing the wall charges, and second set row writing means for applying scanning pulses which are inverted between positive and negative polarities in said first and second states in opposite relation to the polarities of the scanning pulses applied by said first set row writing means, to said scanning electrodes in second set rows other than said first set rows for writing the wall charges.

For writing the wall charges, the first set column writing means applies data pulses of a predetermined polarity to said data electrodes in first set columns, and the second set column writing means applies data pulses whose positive and negative polarities are opposite to the data pulses applied by said first set column writing means, to said data electrodes in second set columns other than said first set columns. The first set row writing means applies scanning pulses which are inverted between positive and negative polarities in first and second states which occur alternately, to said scanning electrodes in first set rows, and the second set row writing means applies scanning pulses which are inverted between positive and negative polarities in said first and second states in opposite relation to the polarities of the scanning pulses applied by said first set row writing means, to said scanning electrodes in second set rows other than said first set rows.

For example, if the data pulses applied to the data electrodes are of positive polarity in the first set columns and of negative polarity in the second set columns, the scanning pulses applied to the scanning electrodes in the first set rows are inverted between positive and negative polarities in the first and second states, and the scanning pulses applied to the scanning electrodes in the second set rows are inverted between negative and positive polarities in the first and second states, then wall charges are written into pixels at the points of intersection between the first set rows and the second set rows and pixels at the points of intersection between the second set columns and the first set rows in the first state, and wall charges are written into pixels at the points of intersection between the first set columns and the first set rows and pixels at the points of intersection between the second set columns and the second set rows in the second state.

Therefore, the pixels arranged vertically and horizontally in a two-dimensional matrix are alternately energized in a staggered grid pattern. The number of pixels which are simultaneously energized is half the number of pixels in the conventional plasma display unit. Therefore, it is possible to prevent a shortage of wall charges due to a voltage drop, so that images can be displayed in good quality even if the plasma display unit has an increased screen size.

According to a second aspect of the present invention, the plasma display unit comprises first set row writing means for applying scanning pulses of a predetermined polarity to said scanning electrodes in first set rows for writing the wall charges, second set row writing means for applying scanning pulses whose positive and negative polarities are opposite to the scanning pulses applied by said first set row writing means to said scanning electrodes in second set rows other than said first set rows for writing the wall charges, first set column writing means for applying data pulses which are inverted between positive and negative polarities in first and second states which occur alternately, to said data electrodes in first set columns for writing the wall charges, and second set column writing means for applying data pulses which are inverted between positive and negative polarities in said first and second states in opposite relation to the polarities of the data pulses applied by said first set column writing means, to said data electrodes in second set columns other than said first set columns for writing the wall charges.

For writing the wall charges, the first set row writing means applies scanning pulses of a predetermined polarity to said scanning electrodes in first set rows, and the second set tow writing means applies scanning pulses whose positive and negative polarities are opposite to the scanning pulses applied by said first set row writing means to said scanning electrodes in second set rows other than said first set rows. The first set column writing means applies data pulses which are inverted between positive and negative polarities in first and second states which occur alternately, to said data electrodes in first set columns, and the second set column writing means applies data pulses which are inverted between positive and negative polarities in said first and second states in opposite relation to the polarities of the data pulses applied by said first set column writing means, to said data electrodes in second set columns other than said first set columns.

For example, if the scanning pulses applied to the scanning electrodes are of positive polarity in the first set rows and of negative polarity in the second set rows, the data pulses applied to the data electrodes in the first set columns are inverted between positive and negative polarities in the first and second states, and the data pulses applied to the data electrodes in the second set columns are inverted between negative and positive polarities in the first and second states, then wall charges are written into pixels at the points of intersection between the first set rows and the second set columns and pixels at the points of intersection between the second set rows and the first set columns in the first state, and wall charges are written into pixels at the points of intersection between the first set rows and the first set columns and pixels at the points of intersection between the second set rows and the second set columns in the second state.

Therefore, the pixels arranged vertically and horizontally in a two-dimensional matrix are alternately energized in a staggered grid pattern. The number of pixels which are simultaneously energized is half the number of pixels in the conventional plasma display unit. Therefore, it is possible to prevent a shortage of wall charges due to a voltage drop, so that images can be displayed in good quality even if the plasma display unit has an increased screen size.

In the above plasma display unit, it is possible to simultaneously apply the scanning pulses from said first set row writing means and said second set row writing means.

Since the first set row writing means and said second set row writing means apply the scanning pulses to the scanning electrodes in the first set rows and the second set rows, two rows of pixels are energized at once even when the pixels are energized in rows. Because in each row the number of pixels that are energized is half, however, the number of pixels that are energized in rows is reduced to half, and images can be displayed at the same rate as with the conventional plasma display unit without increasing the processing burden for image data.

It is possible to simultaneously apply scanning pulses from said first set row writing means and said second set row writing means to a pair of said scanning electrodes in said first and second set rows which are spaced apart by a predetermined number of rows.

Since said first set row writing means and said second set row writing means simultaneously apply scanning pulses to a pair of said scanning electrodes in said first and second set rows, the writing of wall charges is not simultaneously carried out in two adjacent rows. Therefore, unwanted wall charges are prevented from being written in error into pixels due to the voltage of scanning pulses applied to adjacent rows, so that images of good quality can be displayed.

The plasma display unit may further comprise sustaining pulse applying means for applying sustaining pulses which flow in alternately inverted directions to said surface-discharge electrode pairs in said first set rows, and applying sustaining pulses which flow in alternately inverted directions, opposite to the sustaining pulses applied to said surface-discharge electrode pairs in said first set rows, to said surface-discharge electrode pairs in said second set rows.

Inasmuch as the sustaining pulse applying means applies sustaining pulses which flow in alternately inverted directions to said surface-discharge electrode pairs in said first set rows, and applies sustaining pulses which flow in alternately inverted directions, opposite to the sustaining pulses applied to said surface-discharge electrode pairs in said first set rows, to said surface-discharge electrode pairs in said second set rows, magnetic noises simultaneously generated in many surface-discharge electrode pairs due to the flow of sustaining pulses cancel out each other in the first set rows and the second set rows, reducing adverse effects on surrounding regions. The sustaining pulses are applied to the scanning electrodes and the sustaining electrodes of the surface-discharge electrode pairs. Since wires of the scanning electrodes are classified into the first set rows and the second set rows for connection to the first and second set row writing means, any complex wires needed for applying the sustaining pulses opposite directions to the surface-discharge electrode pairs in the first set rows and the second set rows can be minimized.

The plasma display unit may further comprise sustaining pulse applying means for applying a voltage which is alternately inverted between positive and negative polarities as sustaining pulses to flow in said surface-discharge electrode pairs to said scanning electrodes, and applying a voltage which is alternately inverted between positive and negative polarities in an opposite pattern to said sustaining electrodes.

The sustaining pulse applying means applies a voltage which is alternately inverted between positive and negative polarities as sustaining pulses to flow in said surface-discharge electrode pairs to said scanning electrodes, and applies a voltage which is alternately inverted between positive and negative polarities in an opposite pattern to said sustaining electrodes, for thereby supplying sustaining pulses to the surface-discharge electrode pairs. Since the voltage applied as sustaining pulses is of opposite polarities on the scanning electrodes and the sustaining electrodes, electric field noises generated in the scanning and sustaining elements of the surface-discharge electrode pairs cancel out each other upon application of the sustaining pulses of a high voltage, reducing adverse effects on surrounding regions.

The plasma display unit may further comprise a discharge accelerator disposed on at least a portion of a surface of each of said data electrodes for accelerating an electric discharge.

When data pulses of negative polarity are applied to the data electrodes, the data electrodes emit secondary electrons. Such secondary electron emission is blocked by the phosphor. The discharge accelerator disposed on at least the portion of the surface of each of said data electrodes accelerates an electric discharge from the data electrodes. Because wall charges can well be written even when data pulses of negative polarity are applied to the data electrodes, the plasma display unit can display images of good quality.

The discharge accelerator may comprise a layer of MgO.

Inasmuch as the discharge accelerator in the form of a layer of MgO is disposed on at least the portion of the surface of each of said data electrodes, the discharge accelerator is capable of accelerating an electric discharge due to its properties and well protecting the data electrodes.

The data electrodes may correspond to colors R, G, B in said first set columns and said second set columns.

As data pulses corresponding to the colors R, G, B are applied to the data electrodes in the first set columns and the second set columns, a number of pixels are energized according to R, G, B image data for displaying a full-color image. At this time, the first set column writing means simultaneously applies data pulses of a predetermined polarity to the data electrodes in the first set columns, and the second set column writing means simultaneously applies data pulses of a polarity opposite to the polarity of the data pulses applied to the data electrodes in the first set columns, to the data electrodes in the second set columns. In each of the set columns, since the data pulses applied to the data electrodes are of the same polarity, any potential difference between adjacent data electrodes due to the presence and absence of written wall charges is made small. Therefore, unwanted wall charges are prevented from being written in error into pixels due to the voltage for writing wall charges applied to adjacent rows, so that color images of good quality can be displayed.

According to a third aspect of the present. invention, a plasma display unit has a plurality of row electrodes extending parallel to a row direction and juxtaposed in a column direction, a plurality of column electrodes extending parallel to the column direction and juxtaposed in the row direction and defining pixels at positions where the row electrodes cross said column electrodes, and a discharge space positioned in a gap between said row electrodes and said column electrodes and containing a phosphor therein, the arrangement being such that drive pulses are successively applied to said row electrodes and said column electrodes, said drive pulses are increased to write wall charges into pixels corresponding to an image, and an electric discharge is generated in the positions of the pixels where the wall charges are written, for thereby enabling the phosphor in said discharge space to emit light for thereby displaying a dot-matrix image, said plasma display unit comprising first set column driving means for applying drive pulses of a predetermined polarity to said column electrodes in first set columns for writing the wall charges, second set column driving means for applying drive pulses whose positive and negative polarities are opposite to the drive pulses applied by said first set column driving means, to said column electrodes in second set columns other than said first set columns for writing the wall charges, first set row driving means for applying drive pulses which are inverted between positive and negative polarities in first and second states which occur alternately, to said row electrodes in first set rows for writing the wall charges, and second set row driving means for applying drive pulses which are inverted between positive and negative polarities in said first and second states in opposite relation to the polarities of the drive pulses applied by said first set row driving means, to said row electrodes in second set rows other than said first set rows for writing the wall charges.

For writing the wall charges, the first set column driving means applies drive pulses of a predetermined polarity to said column electrodes in first set columns, and the second set column driving means applies drive pulses whose positive and negative polarities are opposite to the drive pulses applied by said first set column driving means, to said column electrodes in second set columns other than said first set columns for writing the wall charges. The first set row driving means applies drive pulses which are inverted between positive and negative polarities in first and second states which occur alternately, to said row electrodes in first set rows for writing the wall charges, and the second set row driving means applies drive pulses which are inverted between positive and negative polarities in said first and second states in opposite relation to the polarities of the drive pulses applied by said first set row driving means, to said row electrodes in second set rows other than said first set rows for writing the wall charges.

For example, if the drive pulses applied to the column electrodes are of positive polarity in the first set columns and of negative polarity in the second set rows, the drive pulses applied to the row electrodes in the first set rows are inverted between positive and negative polarities in the first and second states, and the drive pulses applied to the row electrodes in the second set rows are inverted between negative and positive polarities in the first and second states, then pixels at the points of intersection between the first set columns and the second set rows and pixels at the points of intersection between the second set columns and the first set rows in the first state display an image, and pixels at the points of intersection between the first set columns and the first set rows and pixels at the points of intersection between the second set columns and the second set rows in the second state display an image.

Therefore, the pixels arranged vertically and horizontally in a two-dimensional matrix are alternately energized in a staggered grid pattern. The number of pixels which are simultaneously energized is half the number of pixels in the conventional plasma display unit. Therefore, it is possible to reduce the burden to drive the pixels to prevent a voltage drop, so that images can be displayed in good quality even if the plasma display unit has an increased screen size.

According to a fourth aspect of the present invention, a plasma display unit comprises first set column driving means for applying drive pulses of a predetermined polarity to said column electrodes in first set columns for writing the wall charges and enabling said phosphor to emit light, second set column driving means for applying drive pulses whose positive and negative polarities are opposite to the drive pulses applied by said first set column driving means, to said column electrodes in second set columns other than said first set columns for writing the wall charges and enabling said phosphor to emit light, first set row driving means for applying drive pulses which are inverted between positive and negative polarities in first and second states which occur alternately, to said row electrodes in first set rows for writing the wall charges and enabling said phosphor to emit light, and second set row driving means for applying drive pulses which are inverted between positive and negative polarities in said first and second states in opposite relation to the polarities of the drive pulses applied by said first set row driving means, to said row electrodes in second set rows other than said first set rows for writing the wall charges and enabling said phosphor to emit light.

For writing the wall charges and enabling said phosphor to emit light, the first set column driving means applies drive pulses of a predetermined polarity to said column electrodes in first set columns, and the second set column driving means applies drive pulses whose positive and negative polarities are opposite to the drive pulses applied by said first set column driving means, to said column electrodes in second set columns other than said first set columns. The first set row driving means applies drive pulses which are inverted between positive and negative polarities in first and second states which occur alternately, to said row electrodes in first set rows, and the second set row driving means applies drive pulses which are inverted between positive and negative polarities in said first and second states in opposite relation to the polarities of the drive pulses applied by said first set row driving means, to said row electrodes in second set rows other than said first set rows.

For example, if the drive pulses applied to the column electrodes are of positive polarity in the first set columns and of negative polarity in the second set columns, the drive pulses applied to the row electrodes in the first set rows are inverted between positive and negative polarities in the first and second states, and the drive pulses applied to the row electrodes in the second set rows are inverted between negative and positive polarities in the first and second states, then pixels at the points of intersection between the first set columns and the second set rows and pixels at the points of intersection between the second set columns and the first set rows in the first state display an image, and pixels at the points of intersection between the first set columns and the first set rows and pixels at the points of intersection between the second set columns and the second set rows in the second state display an image.

Therefore, the pixels arranged vertically and horizontally in a two-dimensional matrix are alternately energized in a staggered grid pattern. The number of pixels which are simultaneously energized is half the number of pixels in the conventional plasma display unit. Therefore, it is possible to reduce the burden to drive the pixels to prevent a voltage drop, so that images can be displayed in good quality even if the plasma display unit has an increased screen size.

In a plasma display unit, a frame is divided into a plurality of subfields in advance, a plurality of display gradations produced by selecting the subfields are established in advance in each frame, image data with the display gradations established for pixels are successively input respectively for frames, subfields corresponding to the display gradations for the pixels of the successively input image data are selected to generate said data pulses, and the process of applying said scanning pulses, said data pulses, and then said sustaining pulses is carried out for each of said subfields, said subfields in said frame comprising two sets of subfields which are produced alternately, said two sets of subfields which are produced alternately being established as said first state and said second state, said subfields in the frame being arrayed in different patterns in said first state and said second state.

When image data with the display gradations established for pixels are successively input respectively for frames, subfields corresponding to the display gradations for the pixels of the successively input image data are selected to generate said data pulses, and the process of applying said scanning pulses, said data pulses, and then said sustaining pulses is carried out for each of said subfields. According to a subfield process, an image wherein display gradations of pixels are expressed equivalently by emission times is displayed. If a moving image is displayed by the subfield process, then moving-image false contouring occurs due to the arrangement of subfields in frames.

However, said subfields in said frame comprise two sets of subfields which are produced alternately, and said two sets of subfields which are produced alternately are established as said first state and said second state. Therefore, a number of pixels arranged vertically and horizontally in a two-dimensional matrix are alternately energized in a staggered grid pattern in subfields in the first and second states, so that moving-image false contouring occurs in different patterns in moving images in the first and second stages that are displayed in the staggered grid pattern. Accordingly, the moving-image false contouring is scattered and reduced to half, making it possible to display multi-gradation moving images of good quality.

The subfields as said first state may be arrayed in said frame such that allotted times thereof are successively increased, and said subfields as said second state may be arrayed in said frame such that allotted times thereof are successively decreased.

As time elapses in the frame, the subfields as the first state have their allotted times successively increased, and the subfields as the second state have their allotted times successively decreased. Even if the display gradations of a pair of pixels that are positioned adjacent to each other in the grid direction and alternately energized in the first and second stages are the same as each other, these pixels are energized and de-energized in opposite patterns. Therefore, moving-image false contouring can be canceled out, making it possible to display multi-gradation moving images of good quality.

The subfields as said first state and said second state may be arrayed such that allotted times thereof are increased toward a center of said frame.

As time elapses in the frame, the subfields as the first and second states have their allotted times successively increased and then successively decreased. The energization time in one of the first and second states is equivalent to the de-energization time in the other. If the subfields as the first and second states change similarly, then since the energization time is increased and decreased and the de-energization is increased and decreased in a corresponding manner, the energized and de-energized states are not concentrated in time, making it possible to display multi-gradation moving images of good quality.

The subfields as said first state and said second state may be arrayed such that allotted times thereof are decreased toward a center of said frame.

As time elapses in the frame, the subfields as the first and second states have their allotted times successively decreased and then successively increased. The energization time in one of the first and second states is equivalent to the de-energization time in the other. If the subfields as the first and second states change similarly, then since the energization time is increased and decreased and the de-energization is increased and decreased in a corresponding manner, the energized and de-energized states are not concentrated in time, making it possible to display multi-gradation moving images of good quality.

The above and other objects, features, and advantages of the present invention will become apparent from the following description with reference to the accompanying drawings which illustrate examples of the present invention.

BRIEF DESCRIPTION OF THE DRAWINGS

FIG. 5*a* is a waveform diagram showing an array of subfields in a frame;

FIG. 5*b* is a waveform diagram showing an array of subfields in plural frames;

FIG. 6 is a waveform diagram showing another array of subfields in plural frame;

DETAILED DESCRIPTION OF THE PREFERRED EMBODIMENTS

A plasma display unit according to a first embodiment of the present invention will be described below with reference to FIGS. 7*a*, 7*b* through 10. Those parts of the plasma display unit according to the first embodiment which are identical to those of the conventional plasma display unit are referred to by identical terms, and will not be described in detail below.

Figure 1:
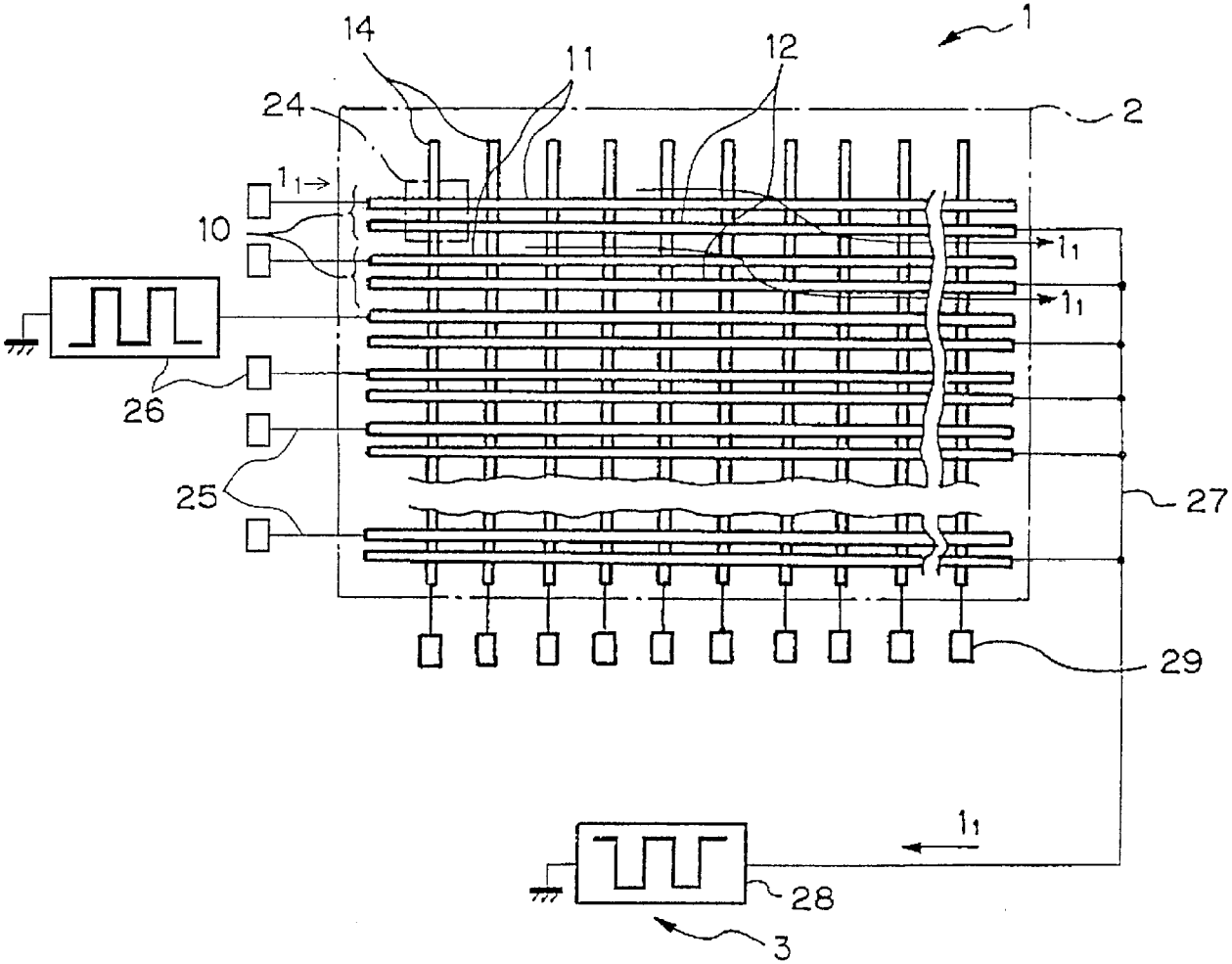
Fig.1(Prior Art)
FIG. 1 is a fragmentary schematic view showing an overall structure of a conventional plasma display unit.
Figure 2:
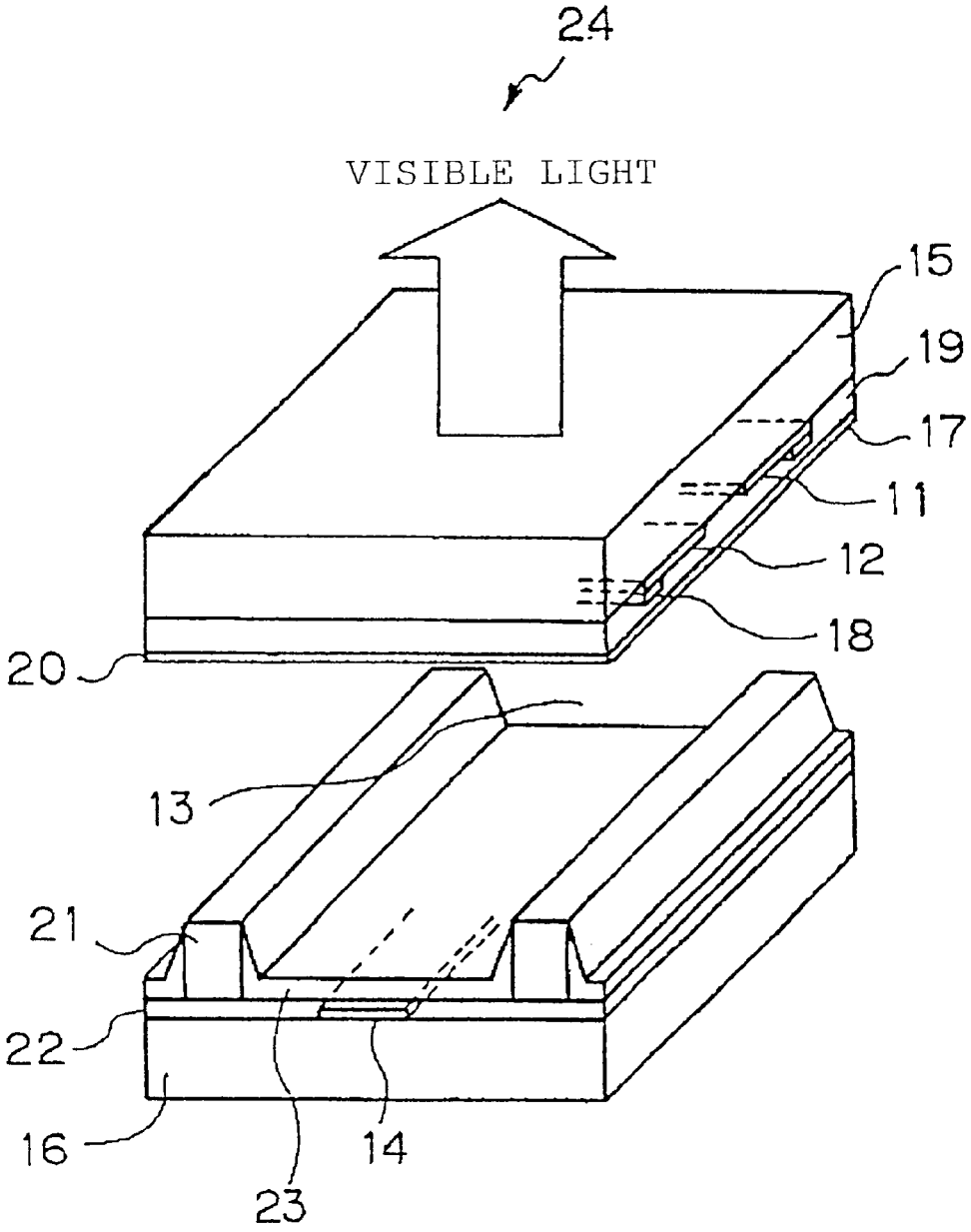
Fig.2(Prior Art)
FIG. 2 is an exploded perspective view of a pixel of the conventional plasma display unit.
Figure 3:
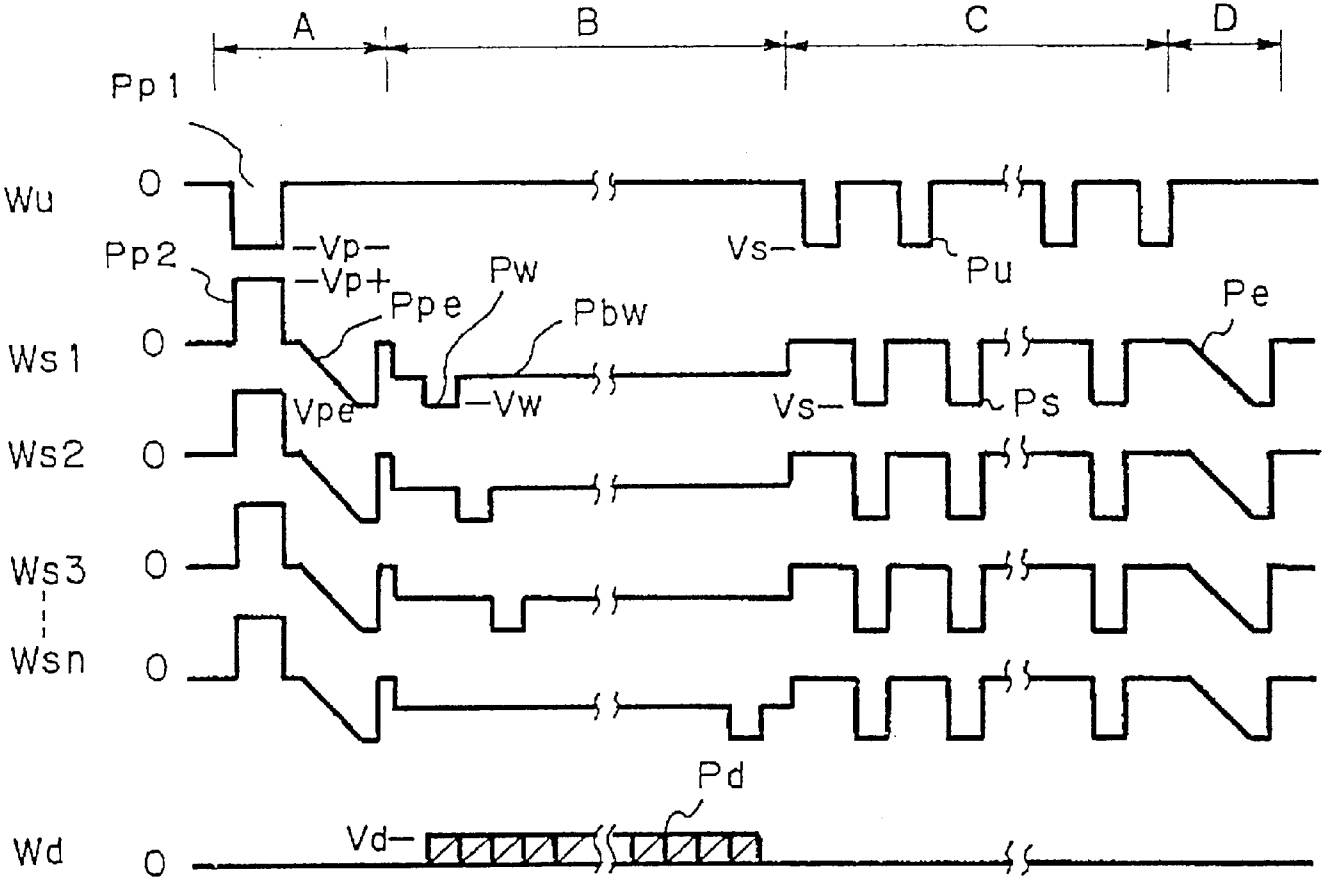
Fig. 3 (Prior Art)
FIG. 3 is a diagram showing the waveforms of various pulses applied to various electrodes of the conventional plasma display unit.
Figure 4:
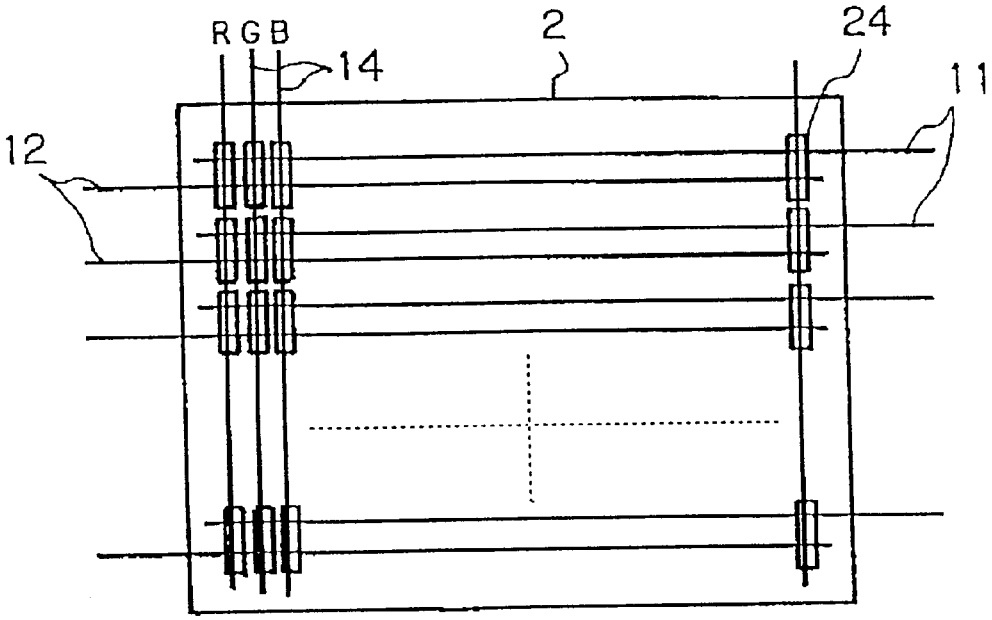
Fig.4(Prior Art)
FIG. 4 is a fragmentary schematic view showing an overall structure of another conventional plasma display unit.
Figure 7A:
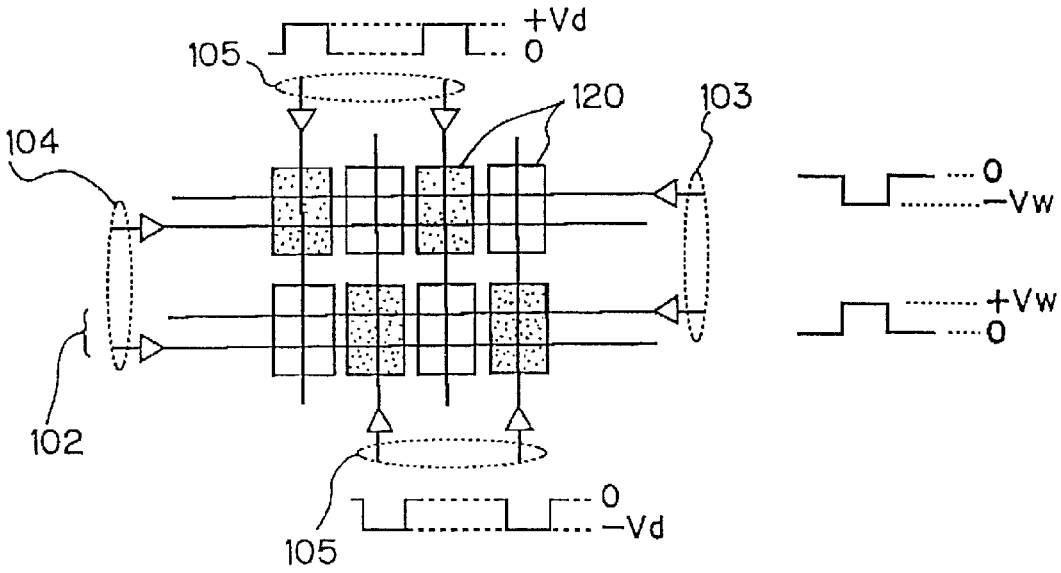
FIG. 7*a* is a fragmentary schematic view showing a first state of an image display process carried out on a plasma display unit according to a first embodiment of the present invention.
Figure 7B:
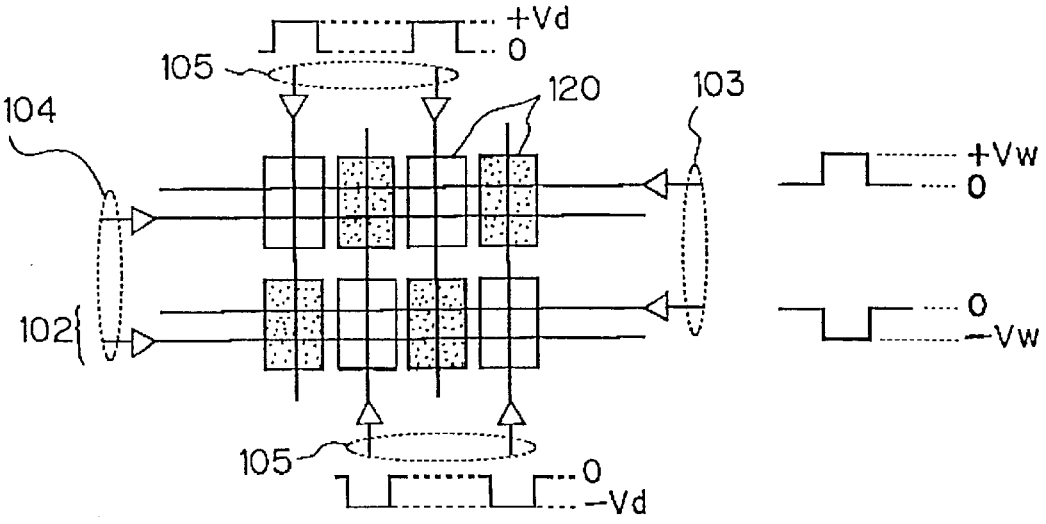
FIG. 7*b* is a fragmentary schematic view showing a second state of the image display process carried out on the plasma display unit according to the first embodiment of the present invention.
Figure 8:
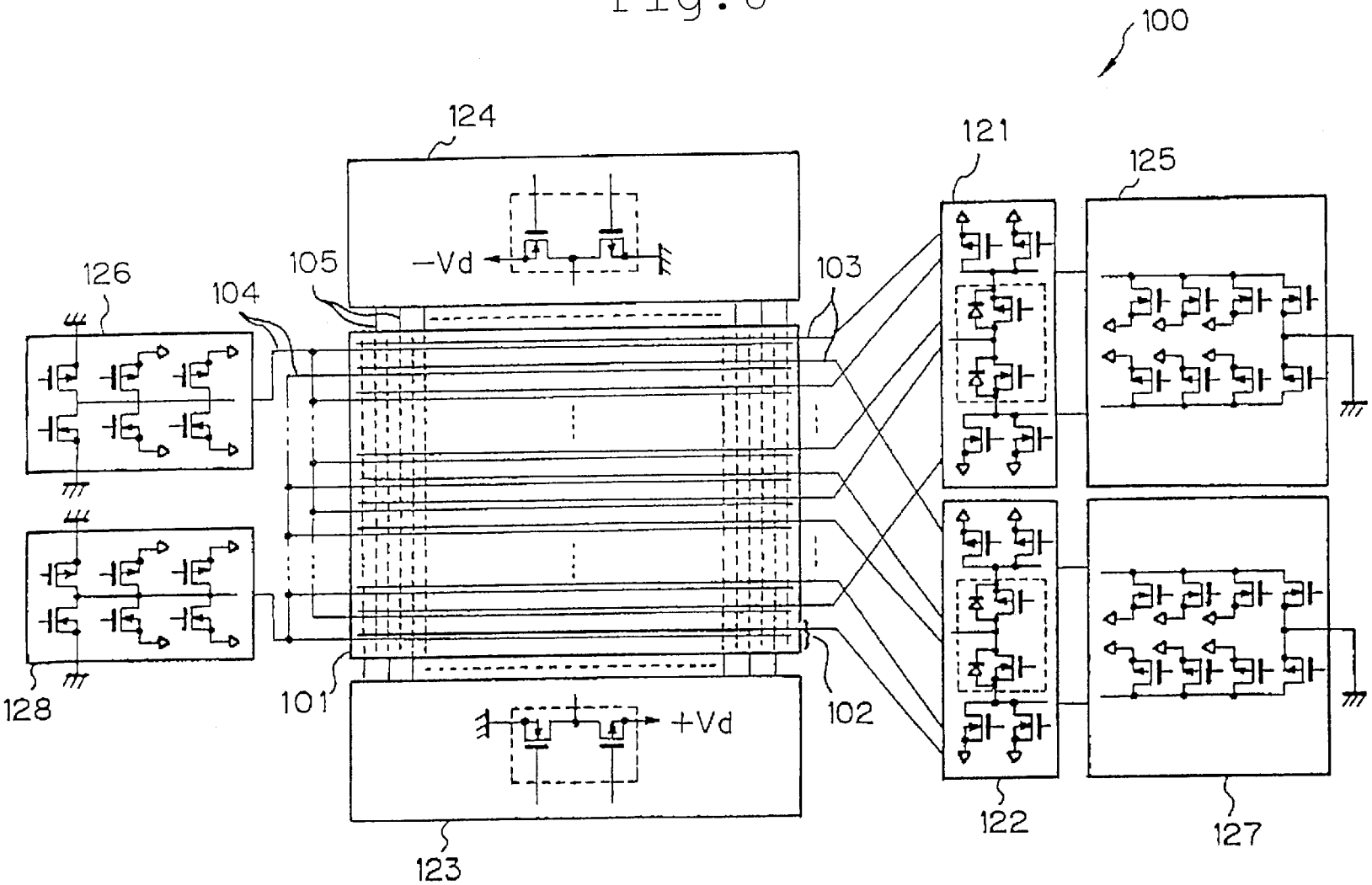
FIG. 8 is a schematic block diagram showing an overall structure of the plasma display unit according to the first embodiment of the present invention.

In this embodiment, the directions of the plasma display unit, e.g., upper, lower, leftward, and rightward directions, are used with respect to FIGS. 7*a*, 7*b*, and 8. Those directions are for illustrative purpose only, and should not be used to limit any directions at the time the plasma display unit is manufactured or used.

As shown in FIG. 8, the plasma display unit 100 according to the first embodiment of the present invention has a display panel 101 on which a number of surface-discharge electrode pairs 102 are disposed as row electrodes parallel to the row direction and juxtaposed in the column direction. Each of the surface-discharge electrode pairs 102 comprises a scanning electrode 103 as an upper electrode and a sustaining electrode 104 as a lower electrode.

Figure 9:
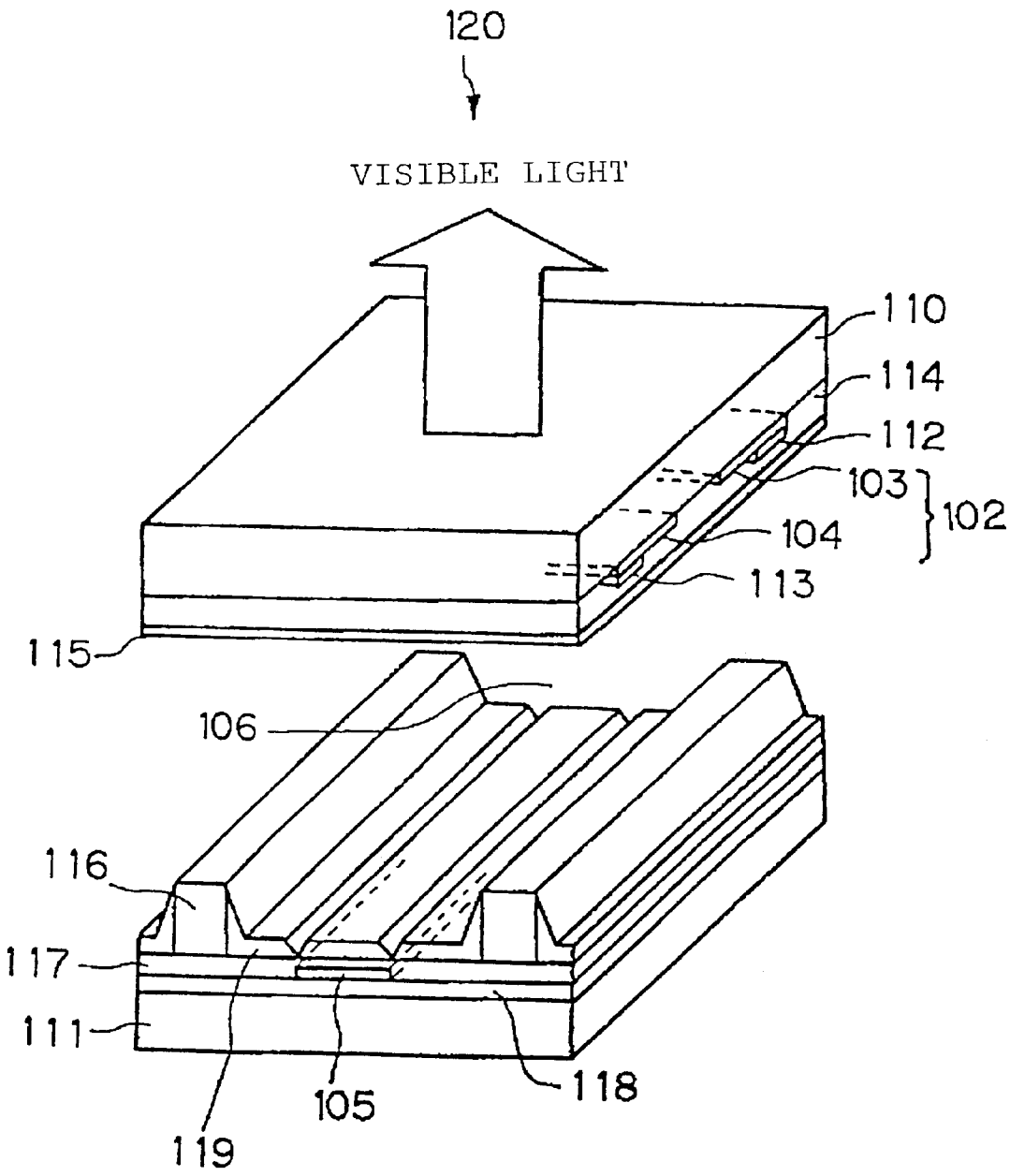
FIG. 9 is an exploded perspective view showing an internal structure of a display cell which serves as a pixel of the plasma display unit according to the first embodiment of the present invention.

Data electrodes 105 are disposed in confronting relation to the surface-discharge electrode pairs 102 with a discharge space 106 interposed therebetween. The data electrodes 105 serve as column electrodes parallel to the column direction and juxtaposed in the row direction. As shown in FIG. 9, the scanning electrode 103 and the sustaining electrode 104 of each of the surface-discharge electrode pairs 102 are disposed on a reverse side of a transparent insulating substrate 110, and each of the data electrodes 105 is disposed on a surface of another insulating substrate 111.

Trace electrodes 112, 113 are disposed respectively on the scanning electrode 103 and the sustaining electrode 104 along edges thereof. A dielectric layer 114 and a protective layer 115 are successively disposed on the entire surface of the reverse side of the insulating substrate 110. Partitions 116 project on both sides of each of the data electrodes 105, and a dielectric layer 117 is disposed on a surface of each of the data electrodes 105.

The plasma display unit 100 differs from the conventional plasma display unit 1 in that a protective layer 118 of MgO is disposed as a discharge accelerator on the surface of the dielectric layer 117 in superposed relation to the data electrode 105. Phosphor layers 119 are disposed on the surface of the dielectric layer 117 one on each side of the protective layer 118 out of superposed relation to the data electrode 105.

The m surface-discharge electrodes pairs 102 and the n data electrodes 105 cross each other with the discharge space 106 interposed therebetween, providing m×n points of intersection successively arranged in the row and column directions as display cells 120 that serve as pixels for individually emitting light. Various drivers 121–128 are connected to the electrodes 102, 105. In the plasma display unit 100, the successive electrodes 102, 105 are classified into odd-numbered electrodes and even-numbered electrodes.

More specifically, as shown in FIG. 8, (m/2) odd-numbered row individual scanning drivers 121 as a first set row writing means are connected individually to (m/2) scanning electrodes 103 in odd-numbered rows as first set rows, and (m/2) even-numbered row individual scanning drivers 122 as a second set row writing means are connected individually to (m/2) scanning electrodes 103 in even-numbered rows as second set rows.

(n/2) odd-numbered column data drivers 123 as a first set column writing means are connected individually to (n/2) data electrodes 105 in odd-numbered columns as first set columns, each comprising one column, and (n/2) even-numbered column data drivers 124 as a second set column writing means are connected individually to (n/2) data electrodes 105 in even-numbered columns.

To (m/2) surface-discharge electrode pairs 102 in odd-numbered rows, there are connected common-to-odd-numbered-rows sustaining drivers 125, 126 as sustaining pulse applying means in common to their scanning and sustaining electrodes 103, 104. To (m/2) surface-discharge electrode pairs 102 in even-numbered rows, there are connected common-to-even-numbered-rows sustaining drivers 127, 128 as sustaining pulse applying means in common to their scanning and sustaining electrodes 103, 104.

The plasma display unit 100 has a single clock control circuit (not shown) connected to the above drivers 121–128. The clock control circuit indicates first and second states, which occur alternately to each other, to the drives 121–128.

Figure 10:
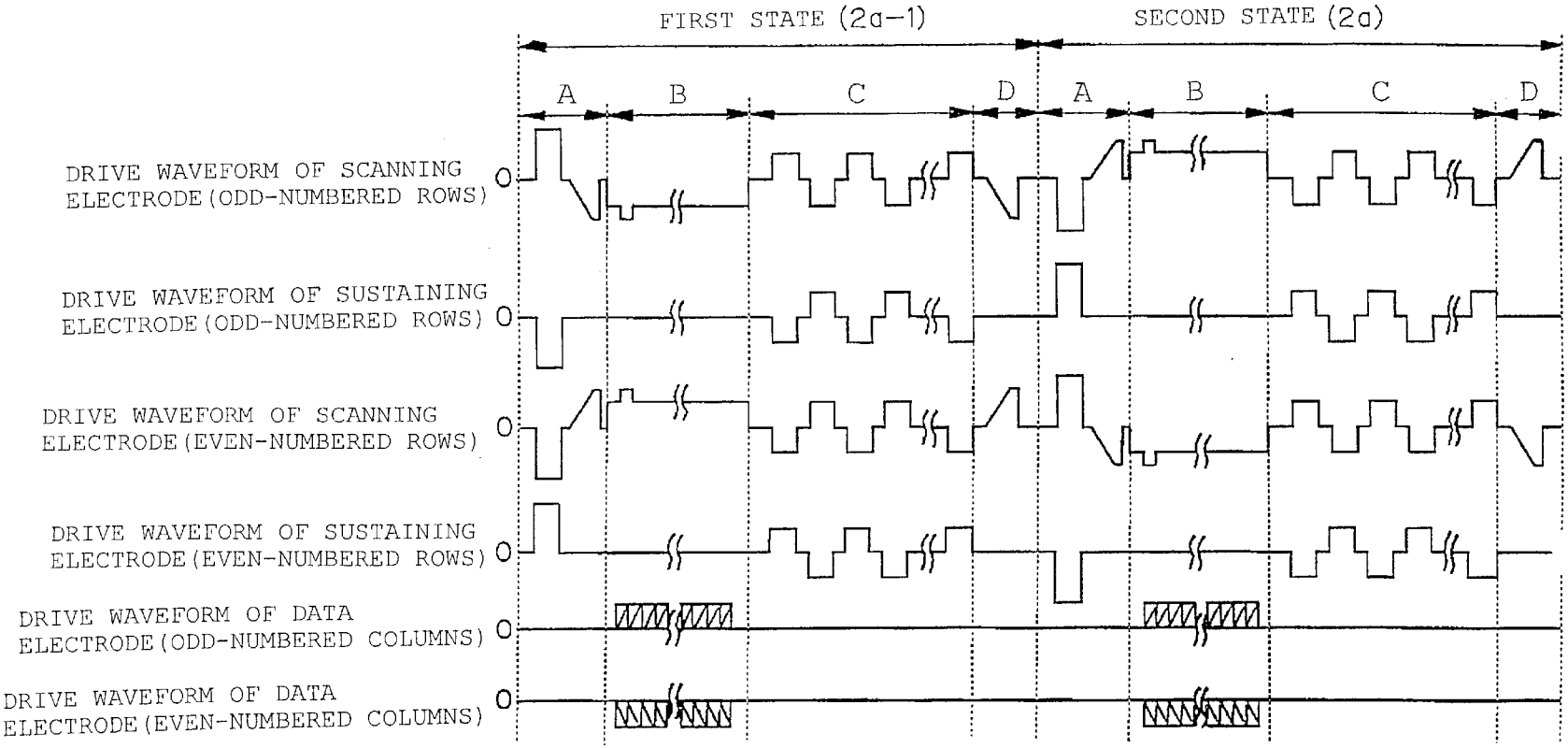
FIG. 10 is a waveform diagram showing the relationship between drive pulses applied to various electrodes.

Each of the first and second states is established as a subfield (on the order of 1.0 to 0.1 (ms)) whose length ranges from one-tenth to one-nine-hundredth of the length of a general TV (Television) frame. As shown in FIG. 10, each of the first and second states which comprises a subfield includes a priming period, a scanning period, a sustaining period, and an erasing period.

In the scanning period of each of the first and second states, the odd-/even-numbered row individual scanning drivers 121, 122 successively generate scanning pulses, and the odd-/even-numbered data drivers 123, 124 individually generate data pulses. In the scanning period of each of the first and second states, the common-to-odd-/even-numbered-rows sustaining drivers 127, 128 generate sustaining pulses.

The odd-numbered row individual scanning drivers 121 apply scanning pulses which are inverted between negative and positive polarities in the first and second states to the scanning electrodes 103 in the odd-numbered rows, and the even-numbered row individual scanning drivers 122 apply scanning pulses which are inverted between positive and negative polarities in the first and second states in opposite relation to the polarities of the scanning pulses applied by the odd-numbered row individual scanning drivers 121, to the scanning electrodes 103 in the even-numbered rows.

The odd-numbered data drivers 123 apply data pulses which are of positive polarity in both the first and second states to the data electrodes 105 in the odd-numbered columns, and the even-numbered data drivers 124 apply data pulses which are of negative polarity in both the first and second states in opposite relation to the polarity of the data pulses applied by the odd-numbered data drivers 123, to the data electrodes 105 in the even-numbered columns.

The common-to-odd-numbered-rows sustaining driver 125 applies sustaining pulses whose voltage is inverted repeatedly between positive and negative values in the sustaining period to the scanning electrodes 103 in the odd-numbered tows, and the common-to-odd-numbered-rows sustaining driver 126 applies sustaining pulses whose voltage is inverted repeatedly between negative and positive values in the sustaining period in opposite relation to the polarity of the sustaining pulses applied by the common-to-odd-numbered-rows sustaining driver 125, to the scanning electrodes 104 in the odd-numbered rows.

The common-to-even-numbered-rows sustaining driver 127 applies sustaining pulses whose voltage is inverted repeatedly between negative and positive values in the sustaining period in opposite relation to the polarity of the sustaining pulses applied by the common-to-odd-numbered-rows sustaining driver 125, to the scanning electrodes 103 in the even-numbered rows, and the common-to-even-numbered-rows sustaining driver 128 applies sustaining pulses whose voltage is inverted repeatedly between positive and negative values in the sustaining period in opposite relation to the polarity of the sustaining pulses applied by the common-to-even-numbered-rows sustaining driver 127, to the scanning electrodes 104 in the even-numbered rows. These sustaining drivers 125–128 output sustaining pulses such that the pattern in which the voltage inversion occurs differs from each other in the first and second states.

In the priming period, the common-to-odd-numbered-rows sustaining driver 125 outputs preliminary discharge pulses which are inverted between positive and negative polarities in the first and second states, and then outputs preliminary discharge erasing pulses which are inverted between negative and positive polarities in the first and second states. In the erasing period, the common-to-odd-numbered-rows sustaining driver 125 outputs sustain erasing pulses which are inverted between positive and negative polarities in the first and second states.

The plasma display unit 100 of the above structure is capable of displaying a desired image in the form of a dot matrix by individually controlling the m×n display cells 120 for light emission.

In the scanning period, scanning pulses are successively applied to the scanning electrodes 103, and data pulses corresponding to an image to be displayed are successively applied to the data electrodes 105, writing wall charges in those display cells 120 which are to display the image. Then, in the sustaining period, sustaining pulses which flow in alternately inverted directions are applied to the surface-discharge electrode pairs 102 to produce an electric discharge in the positions of the display cells 120 where the wall charges have been written, causing the phosphor layers 119 of those display cells 120 to emit light for thereby displaying an image.

For displaying frames of image on the plasma display unit 100, each of the frames is divided into an even number of subfields, and the image is displayed by bringing the successive subfields alternately into the first and second states.

As shown in FIG. 10, in the scanning period, data pulses corresponding to odd-numbered columns of the dot-matrix image are applied in positive polarity to the data electrodes 105 in odd-numbered columns by the odd-numbered column data drivers 123 in both the first and second states, and data pulses corresponding to even-numbered columns of the dot-matrix image are applied in negative polarity to the data electrodes 105 in even-numbered columns by the even-numbered column data drivers 124 in both the first and second states.

At this time, scanning pulses which are inverted between negative and positive polarities in the first and second states that occur alternately are applied to the scanning electrodes 103 in the odd-numbered rows by the odd-numbered row individual scanning drivers 121, and scanning pulses which are inverted between positive and negative polarities in the first and second states are applied to the scanning electrodes 103 in the even-numbered rows by the even-numbered row individual scanning drivers 122.

Therefore, as shown in FIG. 7*a*, in the first state, wall charges are written in the display cells 120 at the points of intersection between odd-numbered rows and odd-numbered columns and the display cells 120 at the points of intersection between even-numbered rows and even-numbered columns, and as shown in FIG. 7*b*, in the second state, wall charges are written in the display cells 120 at the points of intersection between even-numbered rows and odd-numbered columns and the display cells 120 at the points of intersection between odd-numbered rows and even-numbered columns.

When the writing of wall charges in all rows and all columns is completed in the scanning period, the common-to-odd-/even-numbered-rows sustaining drivers 125–128 apply sustaining pulses whose directions are inverted at high speed to the surface-discharge electrode pairs 102 in all rows in the sustaining period. Therefore, the display cells 120 arranged vertically and horizontally in a two-dimensional matrix are alternately energized in a staggered grid pattern, displaying an image.

In the plasma display unit 100, when wall charges are written in a number of display cells 120, the odd-/even-numbered row individual scanning drivers 121, 122 apply scanning pulses to the scanning electrodes 103 in the odd-/even-numbered rows, one row at a time.

The number of display cells 120 in one row in which wall charges are simultaneously written by one of the odd-/even-numbered row individual scanning drivers 121, 122 is half the number of display cells in the conventional plasma display unit, at maximum. Therefore, it is possible to reduce the burden on each of the odd-/even-numbered row individual scanning drivers 121, 122 to half, preventing the scanning pulses from suffering a voltage drop and hence preventing displayed images from being lowered in quality due to a writing failure of wall charges.

The plasma display unit 100 displays one frame of image data divided in the first and second stages. The odd-/even-numbered row individual scanning drivers 121, 122 apply scanning pulses at the same time. Therefore, since in each of the states wall charges are written for every two rows, the processing burden for image display will not be increased.

In the plasma display unit 100, the directions in which the sustaining pulses flow to the odd-/even-numbered row surface-discharge electrode pairs 102 are opposite to each other in the first and second states. Therefore, magnetic noises generated when the sustaining pulses of a high voltage flow are canceled out.

Since magnetic noises and electric field noises can be canceled out, the plasma display unit 100 does not adversely affect nearby electric appliances. Stated otherwise, since sustaining pulses of a sufficiently high voltage can be applied to the surface-discharge electrode pairs 102, the plasma display unit 100 is capable of displaying images with high luminance.

An EMI (Electro-Magnetic Interference) filter for blocking electromagnetic noises generated by the plasma display unit 100 may be omitted, and a thin EMI filter with high visible light transmittance can be used. Accordingly, the luminance of displayed images can be increased, and the plasma display unit 100 can be simplified in structure and manufactured for increased productivity.

In order for the sustaining pulses to flow in opposite directions to the odd-/even-numbered row surface-discharge electrode pairs 102, it is necessary to classify the wires of the surface-discharge electrode pairs 102 according to odd-/even-numbered rows. In the plasma display unit 100, since the wires of the scanning electrodes 103 have been classified according to odd-/even-numbered rows in order to control the writing of wall charges, the directions in which the sustaining pulses flow can be controlled by additionally designing the wires of the sustaining electrodes 104.

In the plasma display unit 100, negative-polarity data pulses are applied to the data electrodes 105 in even-numbered columns. Consequently, the data electrodes 105 emit secondary electrons. Such secondary electron emission is blocked by the phosphor layers 119. On the surface of each of the data electrodes 105, no phosphor layer 119 is placed, but the protective layer 118 of MgO is disposed.

Because discharges of the data electrodes 105 in. the even-numbered columns are accelerated by the protective layers 118 of MgO, no writing failure of wall charges occurs in only the data electrodes 105 in even-numbered columns allowing images of good quality to be displayed. Particularly, the protective layers 118 of MgO not only accelerate discharges due to their properties, but also well protect the data electrodes 105. Therefore, the data electrodes 105 suffer less aging, increasing the durability of the plasma display unit 100.

In the plasma display unit 100, whereas the data pulses have a fixed polarity, but the scanning pulses have polarities inverted in the first and second states. For this reason, the odd-/even-numbered scanning drivers 121, 122 have a more complex circuit structure than the conventional plasma display units. However, inasmuch as the display panel 101 is of a general horizontally elongate rectangular shape with the surface-discharge electrode pairs 102 being fewer than the data electrodes 105, any required circuit structure complexities are held to a minimum.

The present invention is not limited to the details of the above embodiment, but may be modified in various ways. For example, while an image is displayed without a gradation expressed by each pixel in the above embodiment, it is possible to display a moving image with a gradation expressed by each pixel.

For displaying such gradations, the conventional subfield process may simply be applied to the plasma display unit 100. In this case, a plurality of subfields in a frame may be grouped into two sets that occur alternately, and the two sets of subfields that occur alternately may be established as the first and second states, respectively.

For alternately establishing two sets of subfields as the first and second states in a frame, the subfields may be arranged in different patterns in the first and second states in the frame. Images in the first and second states that are displayed in a staggered grid pattern suffer different forms of moving-image false contouring. Therefore, any moving-image false contouring that is visually perceived can be reduced to half.

Figure 11:
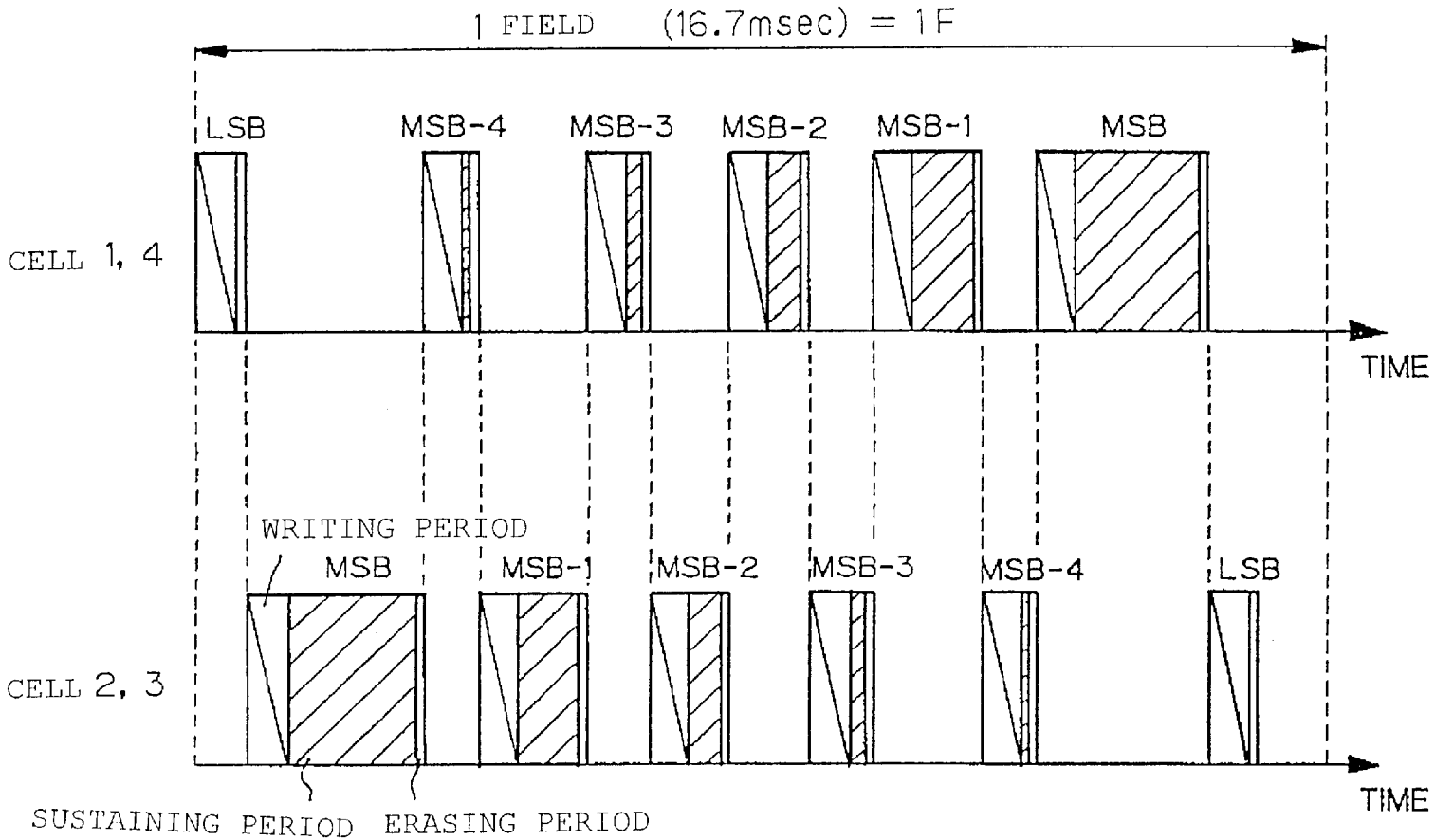
FIG. 11 is a waveform diagram showing an array of subfields according to a first modification.

The subfields can be arranged in various different patterns in the first and second states in the frame. For example, as shown in FIG. 11, the subfields can be arranged such that subfields in the first state are arrayed in the frame with their allotted times progressively increasing, and subfields in the second state are arrayed in the frame with their allotted times progressively decreasing.

Even if gradations displayed by a pair of display cells 120 that are positioned adjacent to each other in the grid direction and alternately energized in the first and second states are the same as each other, since these display cells 120 are energized indifferent patterns, the moving-image false contouring of the images in the first and second states is well canceled out.

If two sets of subfields are established in one frame, then the allotted time of each of the subfields is reduced to half the allotted time in the conventional plasma display unit. However, since the plasma display unit 100 can write wall charges for every two rows, as described above, the processing burden for image display will not be increased.

With two sets of subfields established in one frame, the energization time in one of the first and second states is equivalent to the de-energization time in the other. According to the above array pattern, therefore, energization and de-energization times may be concentrated in time, possibly inducing moving-image false contouring in each of the states.

If the above moving-image false contouring poses a problem, then it is preferable to arrange a plurality of subfields in the first and second states such that subfields are arrayed with their allotted times progressively increasing toward the center of the frame. In this case, since the subfields in the first and second states change similarly with their energization times and de-energization times increasing and decreasing in a corresponding manner, energized and de-energized states thereof are not concentrated in time, resulting in effective prevention of moving-image false contouring.

As shown in FIG. 11, if the subfields in the first and second states are arrayed in opposite patterns, then though moving-image false contouring tends to be induced individually in the first and second states, such an arrangement is still highly effective to generate moving-image false contouring differently in the first and second states and hence cancel it out.

Figure 12:
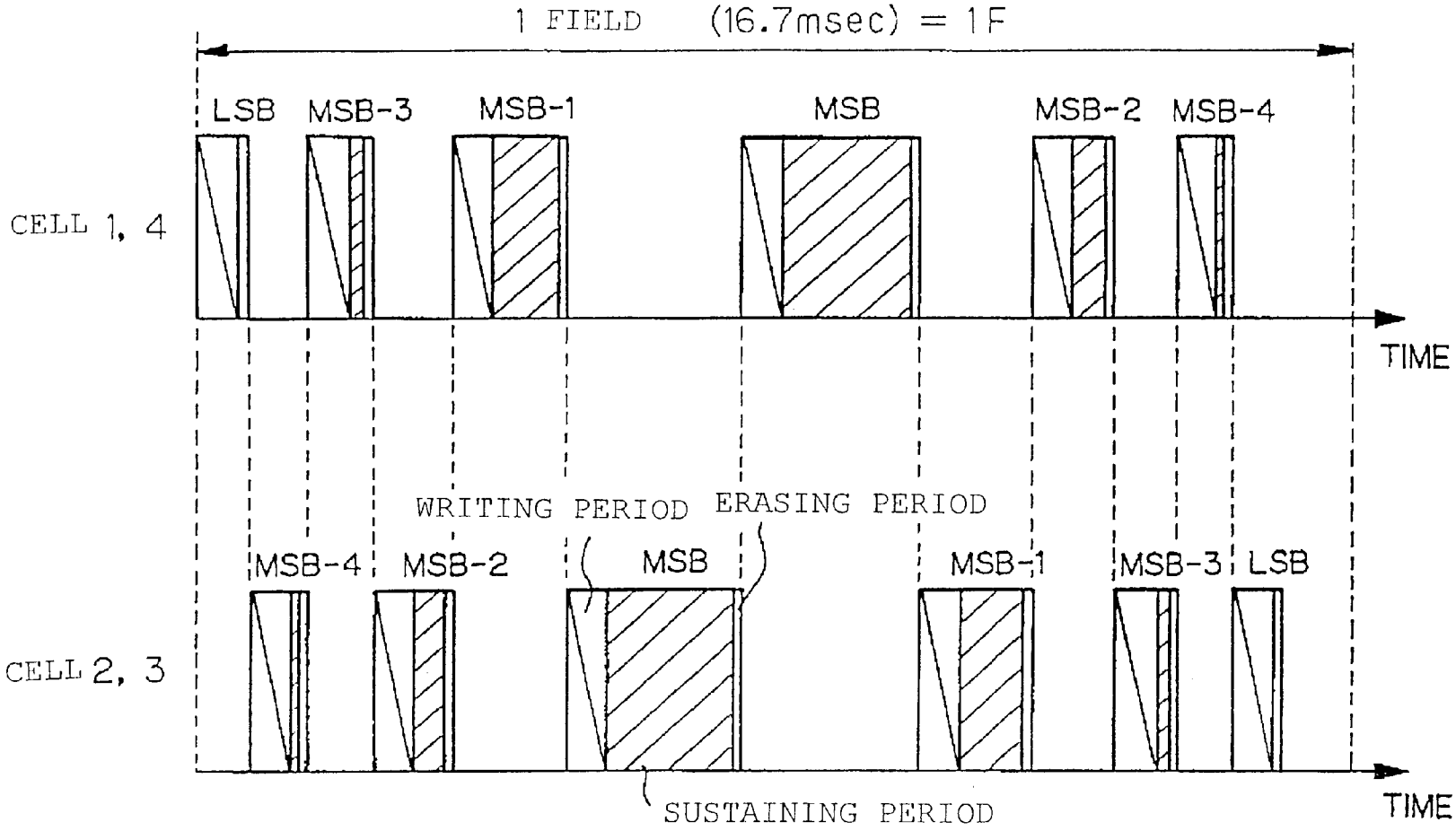
FIG. 12 is a waveform diagram showing an array of subfields according to a second modification.

As shown in FIG. 12, if the subfields in the first and second states are arrayed in similar patterns, moving-image false contouring is generated similarly in the first and second states, and canceled out less effectively. However, moving-image false contouring generated individually in the first and second states is reduced. Since the above arrayed patterns offer their own advantages and disadvantages, it is preferable to select and unify those arrayed patterns in view of various conditions. Arraying the subfields with their allotted times progressively increasing toward the center of the frame naturally operate-in the same manner as the arrayed pattern shown in FIG. 12.

Figure 13:
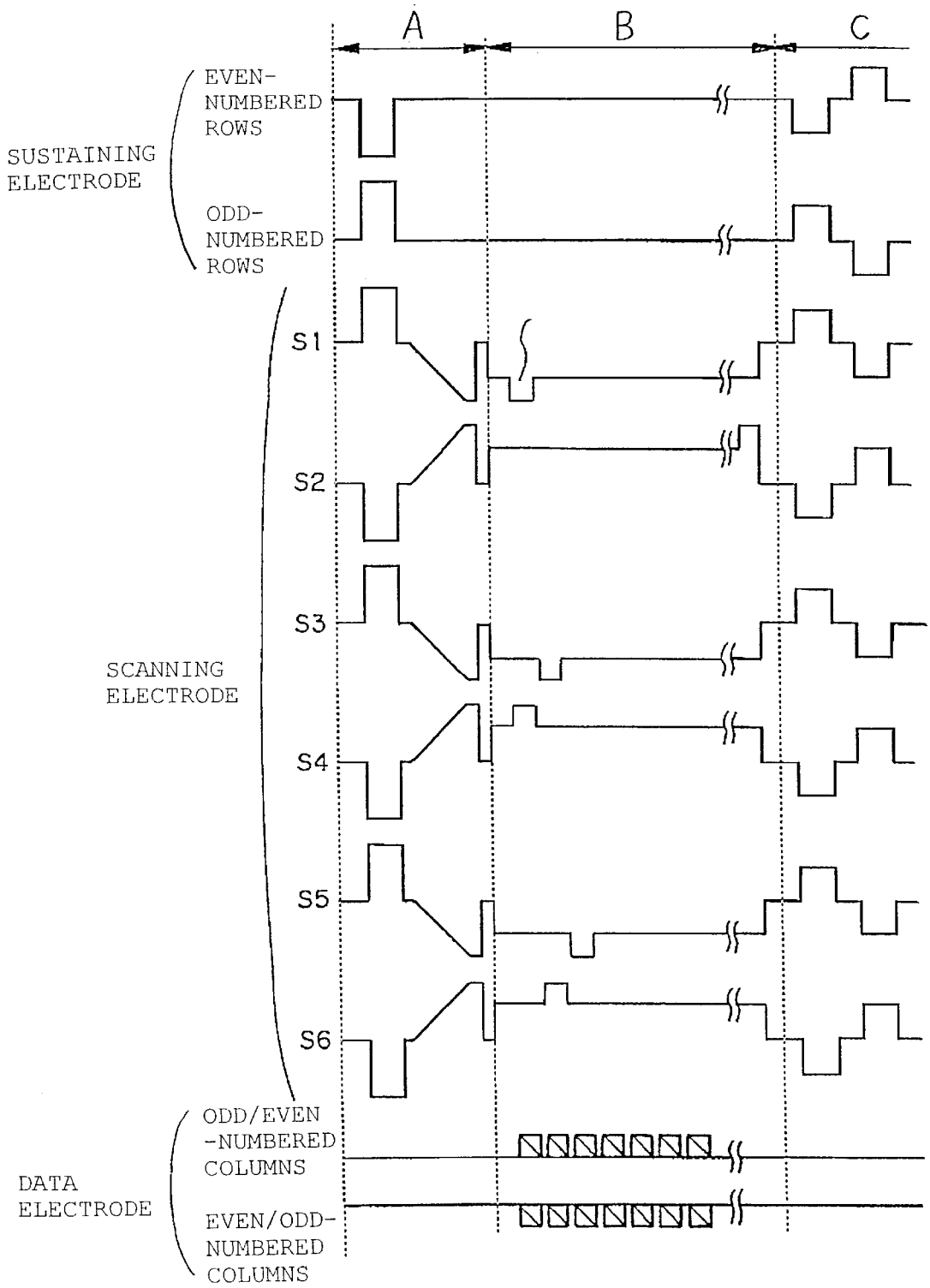
FIG. 13 is a waveform diagram showing an array of subfields according to a third modification.

In the above embodiment, the odd-/even-numbered row individual scanning drivers 121, 122 simultaneously apply scanning pulses to the scanning electrodes 103 in the adjacent odd-/even-numbered rows. However, as shown in FIG. 13, it is possible to space a pair of scanning electrodes 103 in odd-/even-numbered rows to which the odd-/even-numbered row individual scanning drivers 121, 122 simultaneously apply scanning pulses, by a predetermined number of rows from each other.

With such a scheme, since the odd-/even-numbered row individual scanning drivers 121, 122 simultaneously apply scanning pulses to the pair of scanning electrodes 103 in odd-/even-numbered rows spaced by the predetermined number of rows from each other, the writing of wall charges is not simultaneously performed in two adjacent rows. Consequently, wall charges are prevented from being written in error into display cells 120 due to the writing and discharging of wall charges in adjacent scanning electrodes 103, resulting in increased quality of displayed images.

A plasma display unit according to a second embodiment of the present invention will be described below with reference to FIGS. 14 and 15. Those parts of the plasma display unit according to the second embodiment and plasma display units according to other embodiments which are identical to those of the plasma display unit according to the first embodiment are referred to as identical terms and denoted by identical reference characters, and will not be described in detail below.

Like the plasma display unit 100 according to the first embodiment, the plasma display unit 200 according to the second embodiment has common-to-odd-numbered-rows sustaining drivers 201, 202 connected to the scanning and sustaining electrodes 103, 104 of the surface-discharge electrode pairs 102 in odd-numbered rows as first set rows, and common-to-even-numbered-rows sustaining drivers 203, 204 connected to the scanning and sustaining electrodes 103, 104 of the surface-discharge electrode pairs 102 in even-numbered rows.

Figure 14:
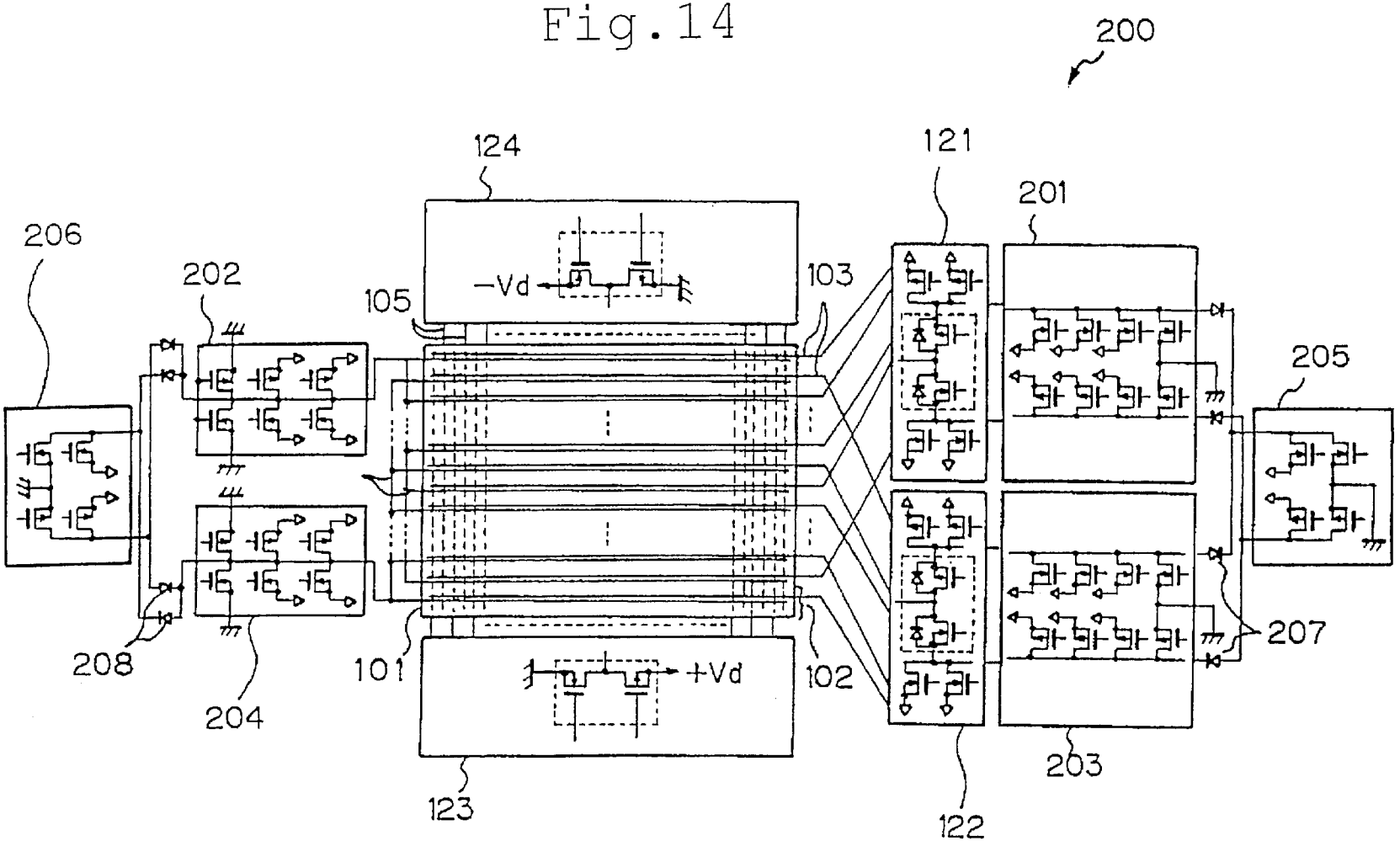
FIG. 14 is schematic block diagram showing an overall structure of a plasma display unit according to a second embodiment of the present invention.

Unlike the plasma display unit 100 according to the first embodiment, as shown in FIG. 14, a single common-to-all-rows sustaining driver 205 is connected to the scanning electrodes 103 in all rows via the common-to-odd-/even-numbered-rows sustaining drivers 201, 203, and a single common-to-all-rows sustaining driver 206 is connected to the sustaining electrodes 104 in all rows via the common-to-odd-/even-numbered-rows sustaining drivers 202, 204. The sustaining drivers 201–206 jointly make up a sustaining pulse applying means.

The common-to-all-rows sustaining driver 205 is connected to the common-to-odd-/even-numbered-rows sustaining drivers 201, 203, and the common-to-all-rows sustaining driver 206 is connected to the common-to-odd-/even-numbered-rows sustaining drivers 202, 204 by wires in which rectifying diodes 207, 208 are inserted.

The common-to-odd-numbered-rows sustaining drivers 201, 202 generate a predetermined voltage which is applied as sustaining pulses to the scanning and sustaining electrodes 103, 104 in odd-numbered rows, individually in negative and positive polarities only in the time of a half pulse finally in the sustaining period in the first state, and individually in negative and positive polarities only in the time of a half pulse initially in the sustaining period in the second state.

The common-to-even-numbered-rows sustaining drivers 203, 204 generate a predetermined voltage which is applied as sustaining pulses to the scanning and sustaining electrodes 103, 104 in even-numbered rows, individually in negative and positive polarities only in the time of a half pulse initially in the sustaining period in the first state, and individually in negative and positive polarities only in the time of a half pulse finally in the sustaining period in the second state.

The common-to-all-rows sustaining driver 205 generates a predetermined voltage which is applied as sustaining pulses to the scanning electrodes 103 in all rows in a pattern in which it is repeatedly inverted between positive and negative polarities and finished in positive polarity, only in a period other than the times of half pulses initially and finally in the sustaining period in both the first and second states.

The common-to-all-rows sustaining driver 206 generates a predetermined voltage which is applied as sustaining pulses to the sustaining electrodes 104 in all rows in a pattern in which it is repeatedly inverted between negative and positive polarities and finished in negative polarity, only in a period other than the times of half pulses initially and finally in the sustaining period in both the first and second states.

Figure 15:
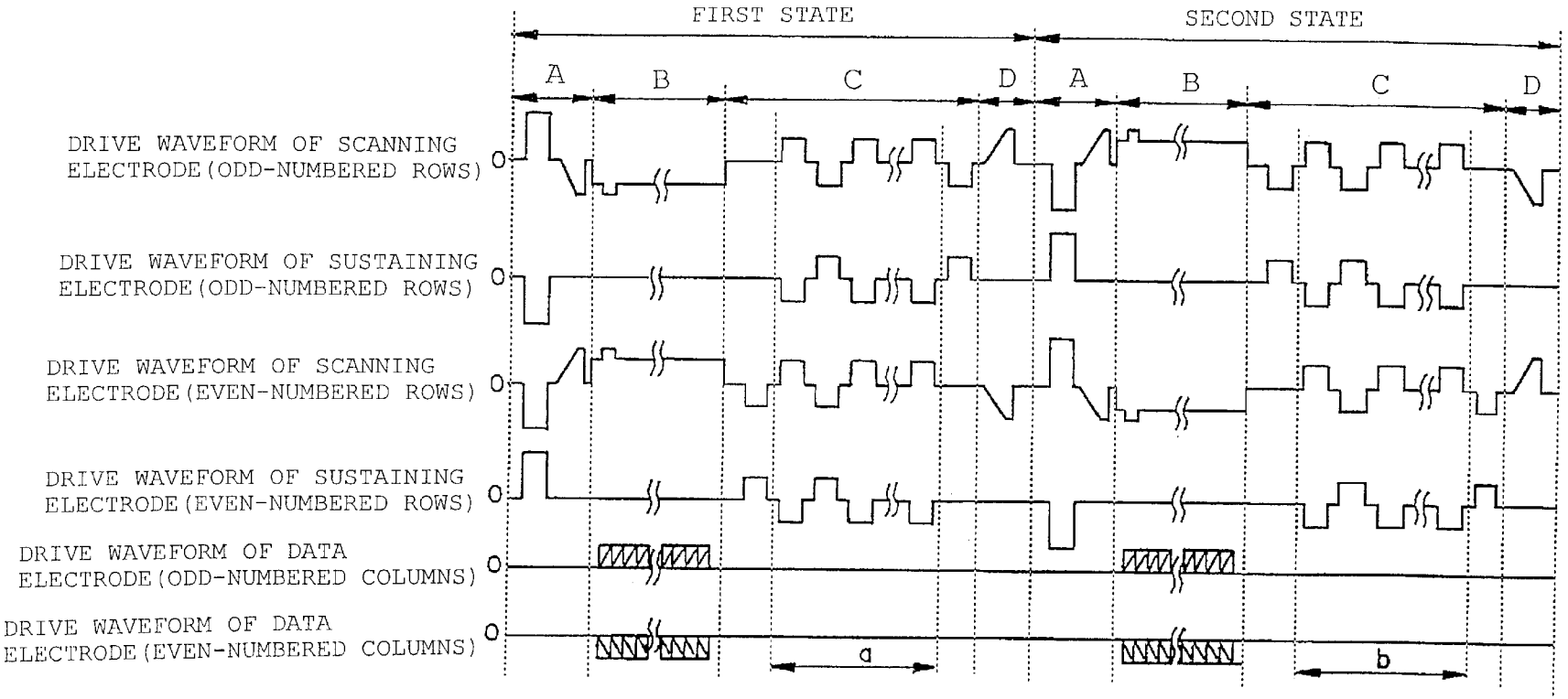
FIG. 15 is a waveform diagram showing the relationship between drive pulses applied to various electrodes.

In the plasma display unit 200, as shown in FIG. 15, sustaining pulses are applied to the surface-discharge electrode pairs 102 in odd-numbered rows, after initially only a half pulse has been awaited, in the sustaining period in the first state. In the-second state, sustaining pulses are applied to the surface-discharge electrode pairs 102 in odd-numbered rows from the start of the sustaining period,with only a final half pulse being omitted.

Conversely, in the sustaining period in the first state, sustaining pulses are applied to the surface-discharge electrode pairs 102 in even-numbered rows from the start of the sustaining period, with only a final half pulse being omitted. In the second state, sustaining pulses are applied to the surface-discharge electrode pairs 102 in even-numbered rows, after initially only a half pulse has been awaited. Therefore, the display cells 120 in which wall charges have been written are energized with sustaining pulses of appropriate polarity. Since the number of such sustaining pulses is the same, the display cells 120 are energized with the same luminance.

In the plasma display unit 200, since sustaining pulses applied to the surface-discharge electrode pairs 102 in all rows are common in a substantially entire period "a" of the sustaining period, the sustaining pulses are generated by only the pair of common-to-all-rows sustaining drivers 205, 206. Though the odd-/even-numbered row sustaining drivers 201–204 are required to generate half sustaining pulses only initially and finally in the sustaining period, these sustaining drivers have a small power requirement, and hence can be reduced in circuit scale.

Accordingly, the entire circuit scale of the sustaining drivers 201–204 can be reduced, and hence the plasma display unit 200 can be reduced in size and weight. Because the sustaining pulses applied to the surface-discharge electrode pairs 102 in odd-/even-numbered rows flow in the same direction, electromagnetic field noises generated when the sustaining pulses of a high voltage are applied cannot be canceled out.

If the common-to-all-rows sustaining drivers 205, 206 and ends in the row direction of the surface-discharge electrode pairs 102 are connected alternately oppositely in odd-/even-numbered rows, or the scanning and sustaining electrodes 103, 104 are arrayed in the column direction in opposite relation to the surface-discharge electrode pairs 102 in odd-/even-numbered rows, then it is possible to cause the sustaining pulses applied to the surface-discharge electrode pairs 102 in odd-/even-numbered rows to flow in opposite directions, canceling out electromagnetic field noises.

In this case, all the sustaining pulses in the sustaining period can be made identical for the scanning electrodes 103 in odd-numbered rows and the sustaining electrodes 104 in even-numbered rows, and also for the scanning electrodes 103 in even-numbered rows and the sustaining electrodes 104 in odd-numbered rows. Therefore, any circuit for generating half sustaining pulses only initially and finally can be dispensed with, resulting in a simpler circuit arrangement and a smaller circuit scale.

A plasma display unit according to a third embodiment of the present invention will be described below with reference to FIGS. 16 through 18*a*, 18*b*.

Figure 16:
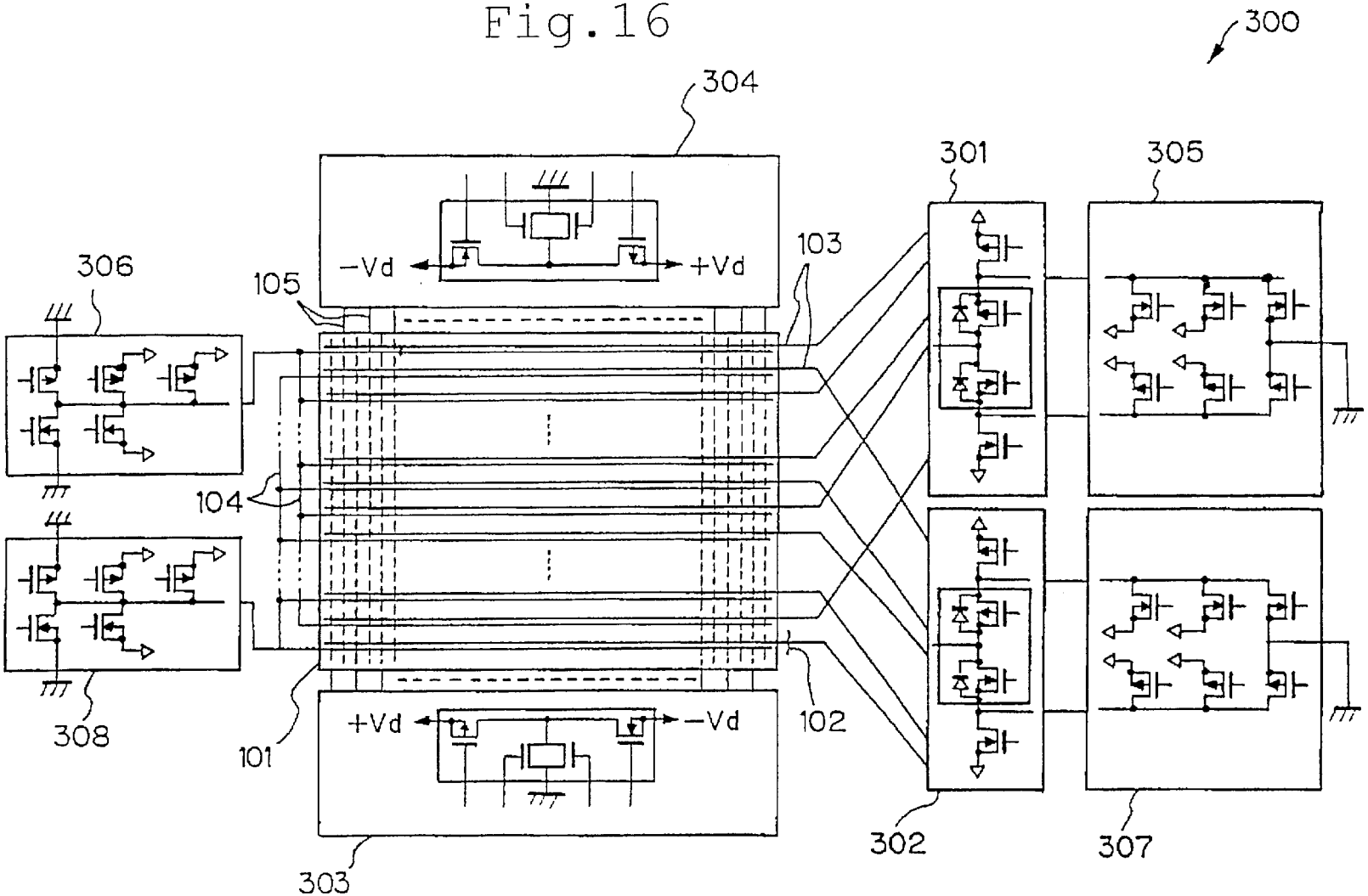
FIG. 16 is schematic block diagram showing an overall structure of a plasma display unit according to a third embodiment of the present invention.

As shown in FIG. 16, the plasma display unit 300 according to the third embodiment has odd-/even-numbered row individual scanning drivers 301, 302 as first/second set row writing means are connected individually to the scanning electrodes 103 in odd-/even-numbered rows of the display panel 101, and odd-/even-numbered column data drivers 303, 304 as first/second set column writing means are connected individually to the data electrodes 105 in odd-/even-numbered columns as first/second set columns, each comprising one column.

Common-to-odd-numbered-rows sustaining drivers 305, 306 as sustaining pulse applying means are connected to the surface-discharge electrode pairs 102 in odd-numbered rows, each common to their scanning and sustaining electrodes 103, 104. Common-to-even-numbered-rows sustaining drivers 307, 308 as sustaining pulse applying means are connected to the surface-discharge electrode pairs 102 in even-numbered rows, each common to their scanning and su staining electrodes 103, 104.

Figure 17:
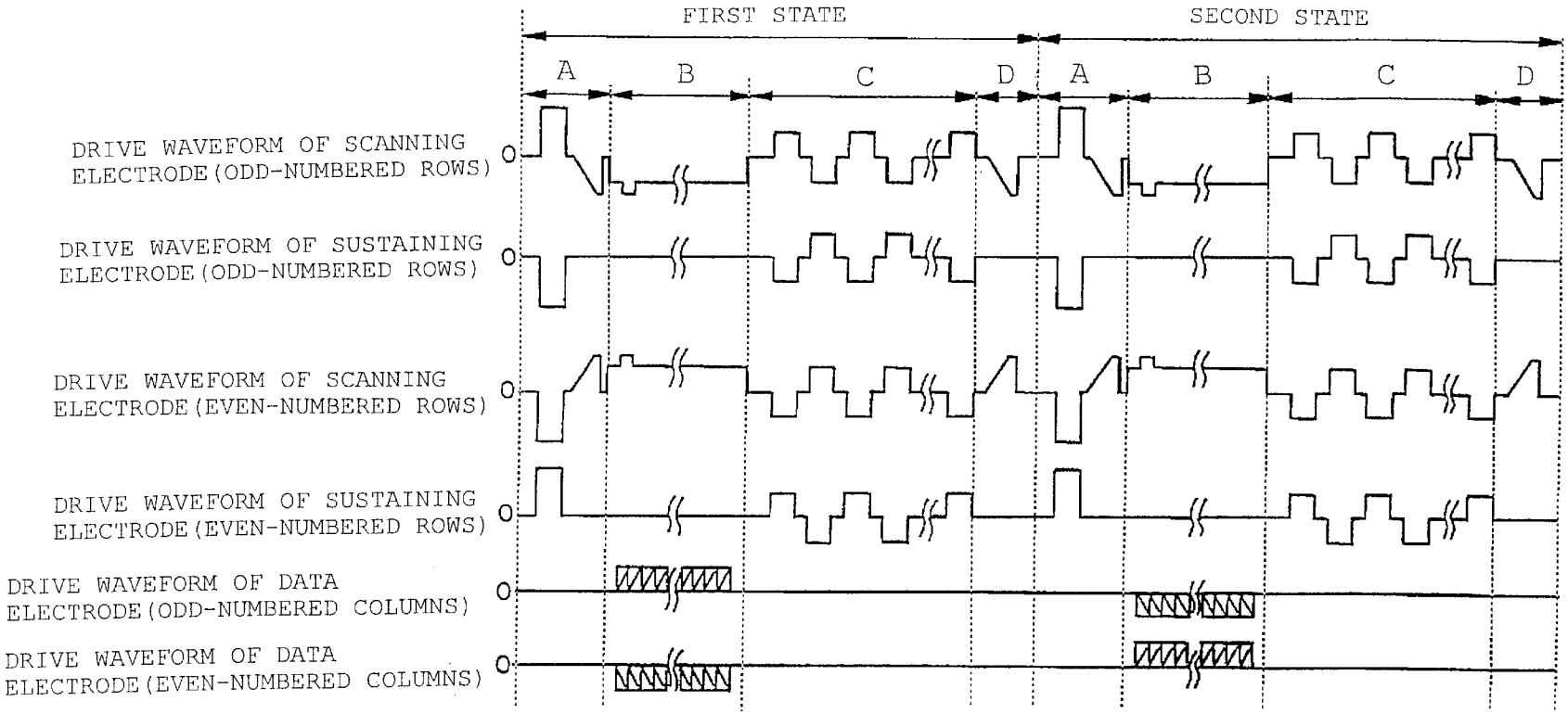
FIG. 17 is a waveform diagram showing the relationship between drive pulses applied to various electrodes.

As shown in FIG. 17, the odd-numbered row individual scanning driver 301 applies scanning pulses of negative polarity to the scanning electrodes 103 in odd-numbered rows in both the first and second states, and the even-numbered row individual scanning driver 302 applies scanning pulses of positive polarity, opposite to the scanning pulses applied by the odd-numbered row individual scanning driver 301, to the scanning electrodes 103 in even-numbered rows in both the first and second states.

The odd-numbered column data driver 303 applies data pulses which are inverted between positive and negative polarities in the first and second states to the data electrodes 105 in odd-numbered columns, and the even-numbered column data driver 304 applies data pulses which are inverted between negative and positive polarities in the first and second states in opposite relation to the polarities of the data pulses applied by the odd-numbered column data driver 303, to the data electrodes 105 in even-numbered columns.

The common-to-odd-numbered-rows sustaining driver 305 applies sustaining pulses whose voltage is repeatedly inverted between positive and negative polarities in the sustaining period to the scanning electrodes 103 in odd-numbered rows, and the common-to-odd-numbered-rows sustaining driver 306 applies sustaining pulses whose voltage is repeatedly inverted between negative and positive polarities in the sustaining period in opposite relation to the polarities of the sustaining pulses applied by the common-to-odd-numbered-rows sustaining driver 305, to the sustaining electrodes 104 in odd-numbered rows.

The common-to-even-numbered-rows sustaining driver 307 applies sustaining pulses whose voltage is repeatedly inverted between negative and positive polarities in the sustaining period in opposite relation to the polarities of the sustaining pulses applied by the common-to-odd-numbered-rows sustaining driver 305, to the scanning electrodes 103 in even-numbered rows, and the common-to-even-numbered-rows sustaining driver 308 applies sustaining pulses whose voltage is repeatedly inverted between positive and negative polarities in the sustaining period in opposite relation to the polarities of the sustaining pulses applied by the common-to-even-numbered-rows sustaining driver 307, to the sustaining electrodes 104 in even-numbered rows. In the sustaining drivers 305–308, the voltages of the sustaining pulses are inverted in a pattern common to the first and second states.

The common-to-odd-numbered-rows sustaining driver 305 outputs preliminary discharge pulses of positive polarity and then preliminary discharge erasing pulses of negative polarity in both the first and second states in the priming period, and outputs sustain erasing pulses of negative polarity in both the first and second states in the erasing period. The common-to-even-numbered-rows sustaining driver 307 outputs preliminary discharge pulses of negative polarity and then preliminary discharge erasing pulses of positive polarity in both the first and second states in the priming period, and outputs sustain erasing pulses of positive polarity in both the first and second states in the erasing period.

In the plasma display unit 300, as shown in FIG. 17, the odd-numbered row individual scanning driver 301 applies scanning pulses of negative polarity to the scanning electrodes 103 in odd-numbered rows in the writing period, and the even-numbered row individual scanning driver 302 applies scanning pulses of positive polarity to the scanning electrodes 103 in even-numbered rows in the writing period.

At this time, data pulses applied from the odd-numbered column data driver 303 to the data electrodes 105 in odd-numbered columns depending on image data are inverted between positive and negative polarities in the first and second states, and data pulses applied from the even-numbered column data driver 304 to the data electrodes 105 in even-numbered columns depending on image data are inverted between negative and positive polarities in the first and second states.

Figure 18A:
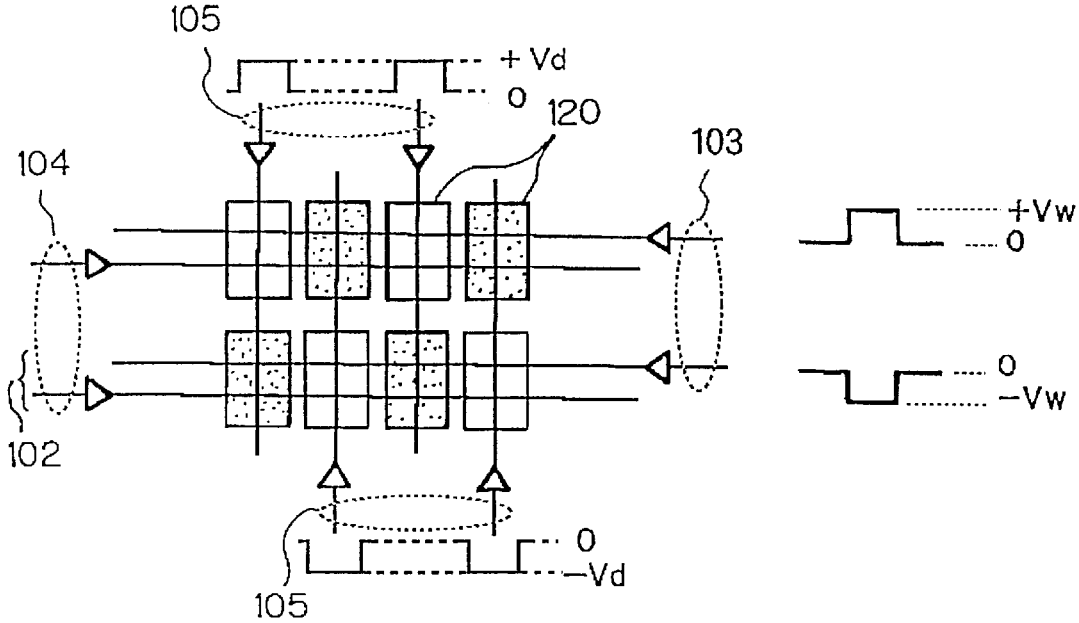
FIG. 18*a* is a fragmentary schematic view showing a first state of an image display process carried out on the plasma display unit according to the third embodiment of the present invention.
Figure 18B:
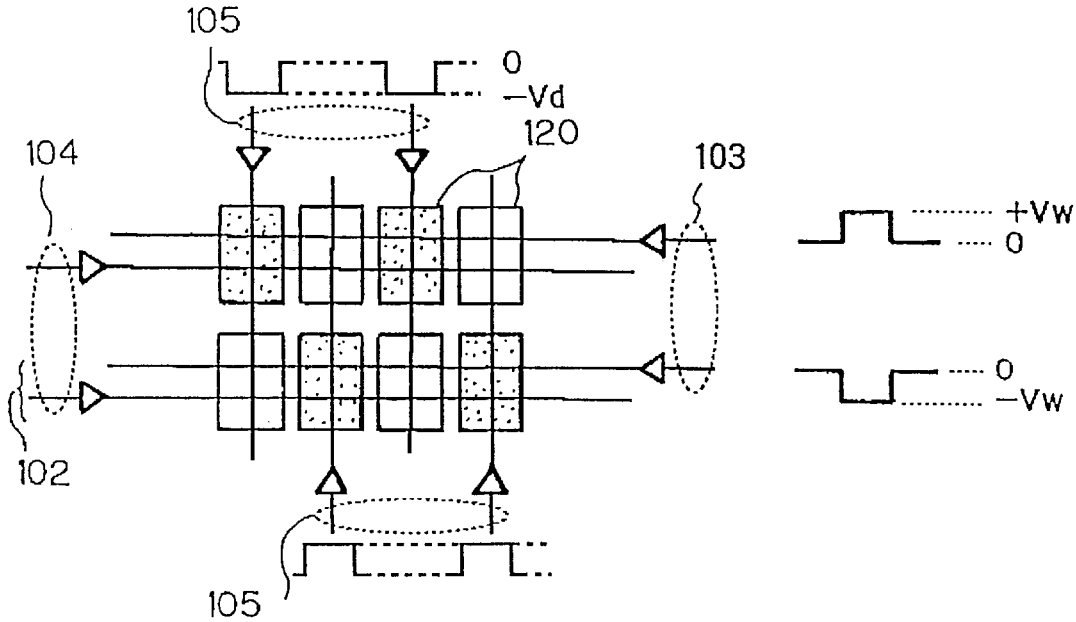
FIG. 18*b* is a fragmentary schematic view showing a second state of the image display process carried out on the plasma display unit according to the third embodiment of the present invention.
Figure 19:
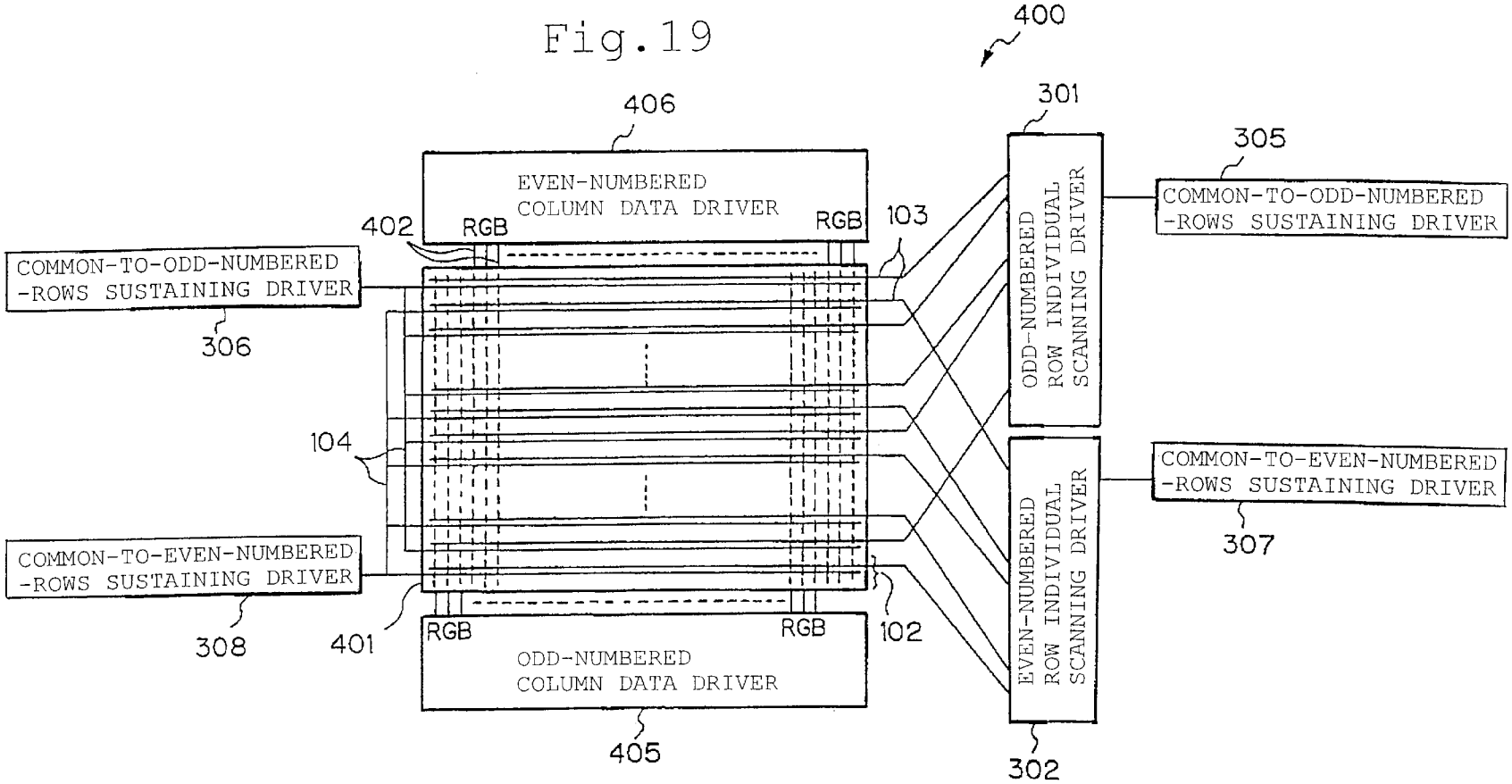
FIG. 19 is schematic block diagram showing an overall structure of a plasma display unit according to a fourth embodiment of the present invention.

As shown in FIG. 18*a*, in the first state, wall charges are written in the display cells 120 at the points of intersection between the odd-numbered rows and the even-numbered columns and the display cells 120 at the points of intersection between the even-numbered rows and the odd-numbered columns. As shown in FIG. 18*b*, in the second state, wall charges are written in the display cells 120 at the points of intersection between the even-numbered rows and the even-numbered columns and the display cells 120 at the points of intersection between the odd-numbered rows and the odd-numbered columns.

Therefore, in the plasma display unit 300, the display cells 120 arranged vertically and horizontally in a two-dimensional matrix are alternately energized in a staggered grid pattern, displaying an image. The number of display cells 120 in one row in which wall charges are simultaneously written by one of the odd-/even-numbered row individual scanning drivers 301, 302 is half the number of display cells in the conventional plasma display unit at maximum. Therefore, it is possible to prevent displayed images from being lowered in quality due to a voltage drop of the scanning pulses.

In the plasma display unit 300, the directions in which the sustaining pulses flow to the odd-/even-numbered row surface-discharge electrode pairs 102 are opposite to each other in the first and second states. Therefore, magnetic noises generated when the sustaining pulses of a high voltage flow are canceled out.

In the plasma display unit 300, furthermore, since the data pulses applied to the data electrodes 105 are inverted in polarity in the first and second states, negative-polarity data pulses are applied to the data electrodes 105, which emit secondary electrons. On the surface of each of the data electrodes 105, no phosphor layer 119 is placed, but the protective layer 118 of MgO is disposed. Consequently, a writing failure of wall charges is prevented, and the data electrodes 105 is subject to reduced aging.

In the plasma display unit 300, drive pulses whose polarity is inverted in the first and second states are data pulses, but not scanning pulses, and the data drivers 303, 304 for outputting data pulses are more than the scanning drivers 301, 302. Accordingly, the number of circuits of complex structure of the plasma display unit 300 is greater than the number of circuits of complex structure of the plasma display unit 100 according to the first embodiment.

However, inasmuch as the scanning pulses, the sustaining pulses, the preliminary discharge pulses, the preliminary discharge erasing pulses, and the erasing pulses remain unchanged in polarity in the first and second states, it is possible to make circuit arrangements for generating these pulses simpler than those of the plasma display unit 100 according to the first embodiment. The plasma display units 100, 300 have complex and simple circuit arrangements of their own, actual products thereof should preferably be selected in view of various conditions.

A plasma display unit according to a fourth embodiment of the present invention will be described below with reference to FIGS. 19 through 22*a*, 22*b*.

The plasma display unit 400 according to the fourth embodiment of the present invention has a display panel 401 structured for full-color image display. Data electrodes 402 are arranged at a three-fold density, and three display cells 403 are arranged in the row direction in a substantially square region. These three display cells 403, making up a set, have respective phosphors (not shown) for light emission in the colors R, G, B.

The data electrodes 402 are also arranged in sets of three columns corresponding to the colors R, G, B. The data electrodes 402 are classified into odd-numbered columns that are first set columns and even-numbered columns that are second set columns. To the data electrodes 402 that are classified into odd-numbered columns, there are individually connected odd-numbered column data drivers 405 as a first set row writing means. To the data electrodes 402 that are classified into even-numbered columns, there are individually connected even-numbered column data drivers 406 as a second set row writing means.

The odd-numbered column data drivers 405 apply R, G, B data pulses that are inverted between positive and negative polarities in the first and second states to the R, G, B data electrodes 402 in odd-numbered columns, and the even-numbered column data drivers 406 apply R, G B data pulses that are inverted between negative and positive polarities in the first and second states in opposite relation to the data pulses applied by the odd-numbered column data drivers 405, to the R, G, B data electrodes 402 in even-numbered columns.

In the plasma display unit 400, the odd-/even-numbered column data drivers 405, 406 apply R, G, B data pulses depending on R, G, B image data to the R, G, B data electrodes 402 for controlling light emission from the R, G, B display cells 402 to display a color image.

Figure 20:
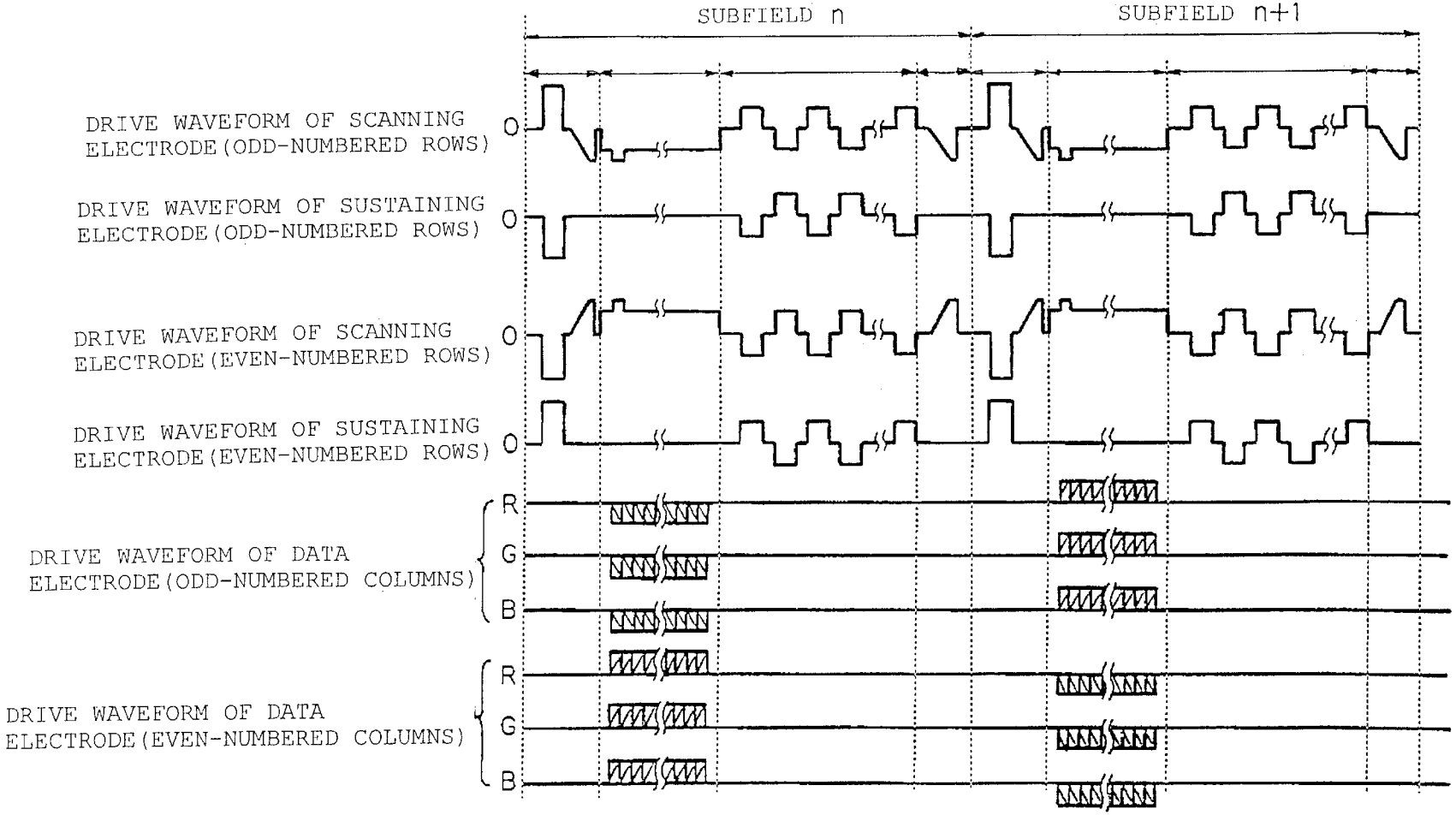
FIG. 20 is a waveform diagram showing the relationship between drive pulses applied to various electrodes.

As shown in FIG. 20, in the writing period, the odd-numbered column data drivers 405 invert the R, G, B data pulses applied to the R, G, B data electrodes 402 in odd-numbered columns between positive and negative polarities in the first and second states, and the even-numbered column data drivers 406 invert the R, G, B data pulses applied to the R, G, B data electrodes 402 in even-numbered columns between negative and positive polarities in the first and second states.

Figure 21A:
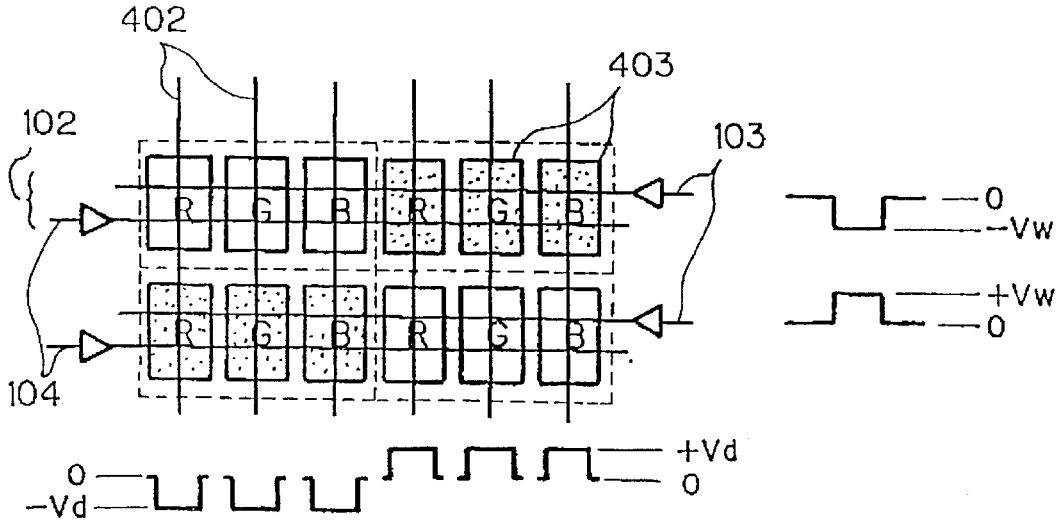
FIG. 21*a* is a fragmentary schematic view showing a first state of an image display process carried out on the plasma display unit according to the fourth embodiment of the present invention.
Figure 21B:
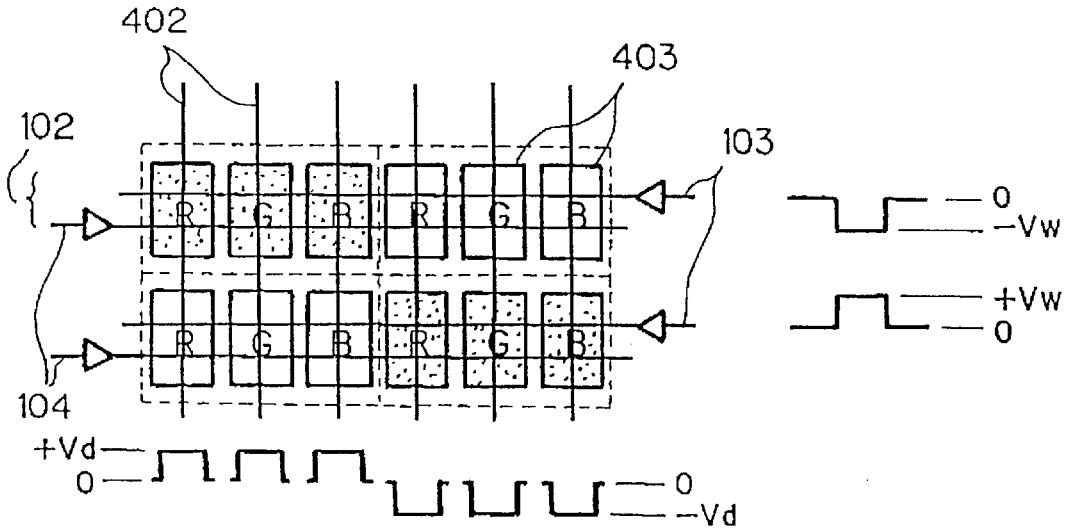
FIG. 21*b* is a fragmentary schematic view showing a second state of the image display process carried out on the plasma display unit according to the fourth embodiment of the present invention.

Therefore, as shown in FIG. 21*a*, in the first state, wall charges are written into three display cells 403 at the points of intersection between odd-numbered rows and even-numbered columns and three display cells 403 at the points of intersection between even-numbered rows and odd-numbered columns, and as shown in FIG. 21*b*, in the second state, wall charges are written into three display cells 403 at the points of intersection between even-numbered rows and even-numbered columns and three display cells 403 at the points of intersection between odd-numbered rows and odd-numbered columns.

Therefore, in the plasma display unit 400, the display cells 403 arranged as sets of three R, G, B display cells vertically and horizontally in a two-dimensional matrix are alternately energized in a staggered grid pattern. The number of display cells 403 in one row in which wall charges are simultaneously written by one of the odd-/even-numbered row individual scanning drivers 301, 302 is half the number of display cells in the conventional plasma display unit, at maximum. Therefore is possible to prevent displayed images from being lowered in quality due to a voltage drop of the scanning pulses.

Figure 22A:
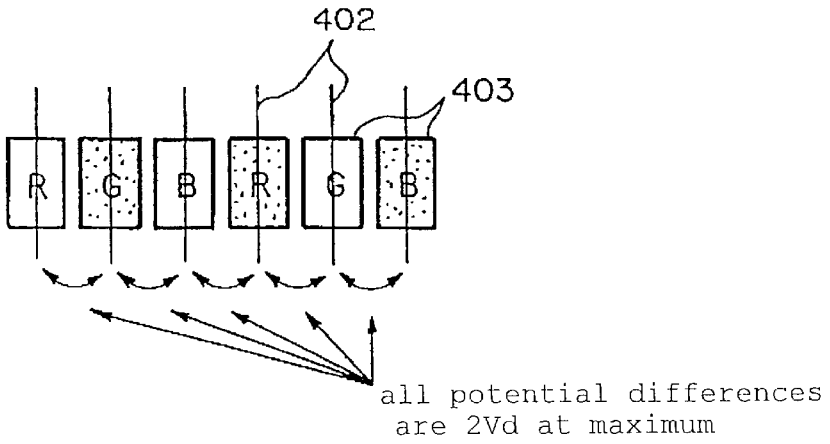
FIG. 22*a* is a diagram illustrative of potential differences between display cells of the plasma display unit according to the first embodiment of the present invention.

As with the plasma display unit 100, if the display cells 403 are energized in a staggered grid pattern with the data electrodes 402 in the columns as respective sets, as shown in FIG. 22*a*, the potential differences between adjacent data electrodes 402 due to the presence and absence of written wall charges, are 2 Vd at maximum.

Figure 22B:
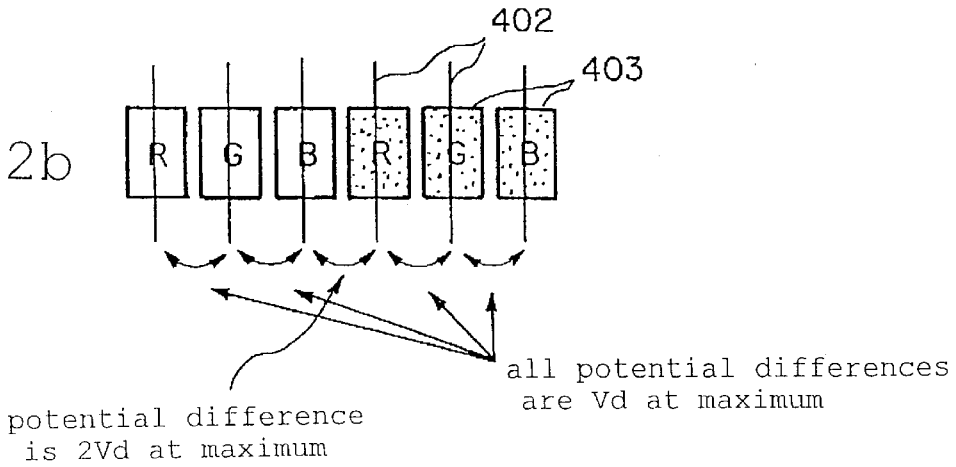
FIG. 22*b* is a diagram illustrative of potential differences between display cells of the plasma display unit according to the fourth embodiment of the present invention.

In the plasma display unit 400, however, within each of sets each comprising three data electrodes 403 corresponding to the colors R, G, B, since the data pulses applied to the data electrodes 402 are of the same polarity, as shown in FIG. 22*b*, the potential differences between adjacent data electrodes 402 due to the presence and absence of written wall charges, are Vd at maximum. Therefore, the possibility that wall charges are written in error into the display cells 403 due to the potential differences with the data electrodes 402 is low, so that a desired level of image quality can well be maintained.

The various embodiments described above may be combined in various combinations insofar as their details contradict each other. For example, while the plasma display unit 400 for full-color image display is arranged such that the polarities of data pulses will be inverted, a plasma display unit for full-color image display may be arranged such that the polarities of scanning pulses will be inverted.

While preferred embodiments of the present invention have been described using specific terms, such description is for illustrative purposes only, and it is to be understood that changes and variations may be made without departing from the spirit or scope of the following claims.

What is claimed is:

1. A plasma display unit having a plurality of surface-discharge electrode pairs of scanning electrodes and sustaining electrodes extending parallel to a row direction and juxtaposed in a column direction, a plurality of data electrodes extending parallel to the column direction and juxtaposed in the row direction and defining pixels at positions where the data electrodes cross said surface-discharge electrode pairs, and a discharge space positioned in a gap between said data electrodes and said surface-discharge electrode pairs and containing a phosphor therein, the arrangement being such that scanning pulses are successively applied to said scanning electrodes and data pulses depending on an image are successively applied to said data electrodes to write wall charges in pixels corresponding to the image, and sustaining pulses flowing in alternately inverted directions are applied to said surface-discharge electrode pairs to cause an electric discharge in the positions of the pixels in which the wall charges are written, for thereby enabling the phosphor in said discharge space to emit light for thereby displaying a dot-matrix image, said plasma display unit comprising:

first set column writing means for applying data pulses of a predetermined polarity to said data electrodes in first set columns for writing the wall charges;

second set column writing means for applying data pulses whose positive and negative polarities are opposite to the data pulses applied by said first set column writing means, to said data electrodes in second set columns other than said first set columns for writing the wall charges;

first set row writing means for applying scanning pulses which are inverted between positive and negative polarities in first and second states which occur alternately, to said scanning electrodes in first set rows for writing the wall charges; and second set row writing means for applying scanning pulses which are inverted between positive and negative polarities in said first and second states in opposite relation to the polarities of the scanning pulses applied by said first set row writing means, to said scanning electrodes in second set rows other than said first set rows for writing the wall charges.

2. A plasma display unit having a plurality of surface-discharge electrode pairs of scanning electrodes and sustaining electrodes extending parallel to a row direction and juxtaposed in a column direction, a plurality of data electrodes extending parallel to the column direction and juxtaposed in the row direction and defining pixels at positions where the data electrodes cross said surface-discharge electrode pairs, and a discharge space positioned in a gap between said data electrodes and said surface-discharge electrode pairs and containing a phosphor therein, the arrangement being such that scanning pulses are successively applied to said scanning electrodes and data pulses depending on an image are successively applied to said data electrodes to write wall charges in pixels corresponding to the image, and sustaining pulses flowing in alternately inverted directions are applied to said surface-discharge electrode pairs to cause an electric discharge in the positions of the pixels in which the wall charges are written, for thereby enabling the phosphor in said discharge space to emit light for thereby displaying a dot-matrix image, said plasma display unit comprising:

first set row writing means for applying scanning pulses of a predetermined polarity to said scanning electrodes in first set rows for writing the wall charges;

second set row writing means for applying scanning pulses whose positive and negative polarities are opposite to the scanning pulses applied by said first set row writing means to said scanning electrodes in second set rows other than said first set rows for writing the wall charges;

first set column writing means for applying data pulses which are inverted between positive and negative polarities in first and second states which occur alternately, to said data electrodes in first set columns for writing the wall charges; and second set column writing means for applying data pulses which are inverted between positive and negative polarities in said first and second states in opposite relation to the polarities of the data pulses applied by said first set column writing means, to said data electrodes in second set columns other than said first set columns for writing the wall charges.

3. A plasma display unit according to claim 1, further comprising means for simultaneously applying the scanning pulses from said first set row writing means and said second set row writing means.

4. A plasma display unit according to claim 2, further comprising means for simultaneously applying the scanning pulses from said first set row writing means and said second set row writing means.

5. A plasma display unit according to claim 1, further comprising means for simultaneously applying scanning pulses from said first set row writing means and said second set row writing means to a pair of said scanning electrodes in said first and second set rows which are spaced apart by a predetermined number of rows.

6. A plasma display unit according to claim 2, further comprising means for simultaneously applying scanning pulses from said first set row writing means and said second set row writing means to a pair of said scanning electrodes in said first and second set rows which are spaced apart by a predetermined number of rows.

7. A plasma display unit according to claim 1, further comprising sustaining pulse applying means for applying sustaining pulses which flow in alternately inverted directions to said surface-discharge electrode pairs in said first set rows, and applying sustaining pulses which flow in alternately inverted directions, opposite to the sustaining pulses applied to said surface-discharge electrode pairs in said first set rows, to said surface-discharge electrode pairs in said second set rows.

8. A plasma display unit according to claim 2, further comprising sustaining pulse applying means for applying sustaining pulses which flow in alternately inverted directions to said surface-discharge electrode pairs in said first set rows, and applying sustaining pulses which flow in alternately inverted directions, opposite to the sustaining pulses applied to said surface-discharge electrode pairs in said first set rows, to said surface-discharge electrode pairs in said second set rows.

9. A plasma display unit according to claim 1, further comprising sustaining pulse applying means for applying a voltage which is alternately inverted between positive and negative polarities as sustaining pulses to flow in said surface-discharge electrode pairs to said scanning electrodes, and applying a voltage which is alternately inverted between positive and negative polarities in an opposite pattern to said sustaining electrodes.

10. A plasma display unit according to claim 2, further comprising sustaining pulse applying means for applying a voltage which is alternately inverted between positive and negative polarities as sustaining pulses to flow in said surface-discharge electrode pairs to said scanning electrodes, and applying a voltage which is alternately inverted between positive and negative polarities in an opposite pattern to said sustaining electrodes.

11. A plasma display unit according to claim 1, further comprising a discharge accelerator disposed on at least a portion of a surface of each of said data electrodes for accelerating an electric discharge.

12. A plasma display unit according to claim 2, further comprising a discharge accelerator disposed on at least a portion of a surface of each of said data electrodes for accelerating an electric discharge.

13. A plasma display unit according to claim 11, wherein said discharge accelerator comprises a layer of MgO.

14. A plasma display unit according to claim 12, where in said discharge accelerator comprises a layer of MgO.

15. A plasma display unit according to claim 1, wherein said data electrodes correspond to colors R, G, B in said first set columns and said second set columns.

16. A plasma display unit according to claim 2, wherein said data electrodes correspond to colors R, G, B in said first set columns and said second set columns.

17. A plasma display unit having a plurality of row electrodes extending parallel to a row direction and juxtaposed in a column direction, a plurality of column electrodes extending parallel to the column direction and juxtaposed in the row direction and defining pixels at positions where the row electrodes cross said column electrodes, and a discharge space positioned in a gap between said row electrodes and said column electrodes and containing a phosphor therein, the arrangement being such that drive pulses are successively applied to said row electrodes and said column electrodes, said drive pulses are increased to write wall charges into pixels corresponding to an image, and an electric discharge is generated in the positions of the pixels where the wall charges are written, for thereby enabling the phosphor in said discharge space to emit light for thereby displaying a dot-matrix image, said plasma display unit comprising:

first set column driving means for applying drive pulses of a predetermined polarity to said column electrodes in first set columns for writing the wall charges;

second set column driving means for applying drive pulses whose positive and negative polarities are opposite to the drive pulses applied by said first set column driving means, to said column electrodes in second set columns other than said first set columns for writing the wall charges;

first set row driving means for applying drive pulses which are inverted between positive and negative polarities in first and second states which occur alternately, to said row electrodes in first set rows for writing the wall charges; and second set row driving means for applying drive pulses which are inverted between positive and negative polarities in said first and second states in opposite relation to the polarities of the drive pulses applied by said first set row driving means, to said row electrodes in second set rows other than said first set rows for writing the wall charges.

18. A plasma display unit having a plurality of row electrodes extending parallel to a row direction and juxtaposed in a column direction, a plurality of column electrodes extending parallel to the column direction and juxtaposed in the row direction and defining pixels at positions where the row electrodes cross said column electrodes, and a discharge space positioned in a gap between said row electrodes and said column electrodes and containing a phosphor therein, the arrangement being such that drive pulses are successively applied to said row electrodes and said column electrodes, said drive pulses are increased to write wall charges into pixels corresponding to an image, and an electric discharge is generated in the positions of the pixels where the wall charges are written, for thereby enabling the phosphor in said discharge space to emit light for thereby displaying a dot-matrix image, said plasma display unit comprising:

first set column driving means for applying drive pulses of a predetermined polarity to said column electrodes in first set columns for writing the wall charges and enabling said phosphor to emit light;

second set column driving means for applying drive pulses whose positive and negative polarities are opposite to the drive pulses applied by said first set column driving means, to said column electrodes in second set columns other than said first -set columns for writing the wall charges and enabling said phosphor to emit light;

first set row driving means for applying drive pulses which are inverted between positive and negative polarities in first and second states which occur alternately, to said row electrodes in first set rows for writing the wall charges and enabling said phosphor to emit light; and second set row driving means for applying drive pulses which are inverted between positive and negative polarities in said first and second states in opposite relation to the polarities of the drive pulses applied by said first set row driving means, to said row electrodes in second set rows other than said first set rows for writing the wall charges and enabling said phosphor to emit light.

19. A plasma display unit according to claim 1, wherein a frame is divided into a plurality of subfields in advance, a plurality of display gradations produced by selecting the subfields are established in advance in each frame, image data with the display gradations established for pixels are successively input respectively for frames, subfields corresponding to the display gradations for the pixels of the successively input image data are selected to generate said data pulses, and the process of applying said scanning pulses, said data pulses, and then said sustaining pulses is carried out for each of said subfields, said subfields in said frame comprising two sets of subfields which are produced alternately;

said two sets of subfields which are produced alternately being established as said first state and said second state;

said subfields in the frame being arrayed in different patterns in said first state and said second state.

20. A plasma display unit according to claim 2, wherein a frame is divided into a plurality of subfields in advance, a plurality of display gradations produced by selecting the subfields are established in advance in each frame, image data with the display gradations established for pixels are successively input respectively for frames, subfields corresponding to the display gradations for the pixels of the successively input image data are selected to generate said data pulses, and the process of applying said scanning pulses, said data pulses, and then said sustaining pulses is carried out for each of said subfields, said subfields in said frame comprising two sets of subfields which are produced alternately;

said two sets of subfields which are produced alternately being established as said first state and said second state;

said subfields in the frame being arrayed in different patterns in said first state and said second state.

21. A plasma display unit according to claim 17, wherein a frame is divided into a plurality of subfields in advance, a plurality of display gradations produced by selecting the subfields are established in advance in each frame, image data with the display gradations established for pixels are successively input respectively for frames, subfields corresponding to the display gradations for the pixels of the successively input image data are selected to generate said data pulses, and the process of applying said scanning pulses, said data pulses, and then said sustaining pulses is carried out for each of said subfields;

said subfields in said frame comprising two sets of subfields which are produced alternately;

said two sets of subfields which are produced alternately being established as said first state and said second state;

said subfields in the frame being arrayed in different patterns in said first state and said second state.

22. A plasma display unit according to claim 18, wherein a frame is divided into a plurality of subfields in advance, a plurality of display gradations produced by selecting the subfields are established in advance in each frame, image data with the display gradations established for pixels are successively input respectively for frames, subfields corresponding to the display gradations for the pixels of the successively input image data are selected to generate said data pulses, and the process of applying said scanning pulses, said data pulses, and then said sustaining pulses is carried out for each of said subfields, said subfields in said frame comprising two sets of subfields which are produced alternately;

said two sets of subfields which are produced alternately being established as said first state and said second state;

said subfields in the frame being arrayed in different patterns in said first state and said second state.

23. A plasma display unit according to claim 19, said subfields as said first state are arrayed in said frame such that allotted times thereof are successively increased, and said subfields as said second state are arrayed in said frame such that allotted times thereof are successively decreased.

24. A plasma display unit according to claim 20, said subfields as said first state are arrayed in said frame such that allotted times thereof are successively increased, and said subfields as said second state are arrayed in said frame such that allotted times thereof are successively decreased.

25. A plasma display unit according to claim 21, said subfields as said first state are arrayed in said frame such that allotted times thereof are successively increased, and said subfields as said second state are arrayed in said frame such that allotted times thereof are successively decreased.

26. A plasma display unit according to claim 22, said subfields as said first state are arrayed in said frame such that allotted times thereof are successively increased, and said subfields as said second state are arrayed in said frame such that allotted times thereof are successively decreased.

27. A plasma display unit according to claim 19, wherein said subfields as said first state and said second state are arrayed such that allotted times thereof are increased toward a center of said frame.

28. A plasma display unit according to claim 20, wherein said subfields as said first state and said second state are arrayed such that allotted times thereof are increased toward a center of said frame.

29. A plasma display unit according to claim 21, wherein said subfields as said first state and said second state are arrayed such that allotted times thereof are increased toward a center of said frame.

30. A plasma display unit according to claim 22, wherein said subfields as said first state and said second state are arrayed such that allotted times thereof are increased toward a center of said frame.

31. A plasma display unit according to claim 19, wherein said subfields as said first state and said second state are arrayed such that allotted times thereof are decreased toward a center of said frame.

32. A plasma display unit according to claim 20, wherein said subfields as said first state and said second state are arrayed such that allotted times thereof are decreased toward a center of said frame.

33. A plasma display unit according to claim 21, wherein said subfields as said first state and said second state are arrayed such that allotted times thereof are decreased toward a center of said frame.

34. A plasma display unit according to claim 22, wherein said subfields as said first state and said second state are arrayed such that allotted times thereof are decreased toward a center of said frame.

* * * * *